US006356727B1

(12) United States Patent
Ishii

(10) Patent No.: US 6,356,727 B1
(45) Date of Patent: Mar. 12, 2002

(54) IMAGE FORMING APPARATUS HAVING A SPECIFIC RELATIONSHIP OF THE DIELECTRIC CONSTANT AND LAYER THICKNESS FOR PHOTOCONDUCTOR AND DEVELOPER LAGERS

(75) Inventor: Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/696,306

(22) Filed: Oct. 26, 2000

(30) Foreign Application Priority Data

Oct. 26, 1999 (JP) ..... 11-304448

(51) Int. Cl.[7] ..... G03G 15/00
(52) U.S. Cl. ..... 399/159; 399/286
(58) Field of Search ..... 399/159, 162, 399/265, 279, 286, 222; 430/120

(56) References Cited

U.S. PATENT DOCUMENTS

| | | | | |
|---|---|---|---|---|
| 4,038,545 A | * | 7/1977 | Komaki et al. | 378/28 |
| 5,729,800 A | * | 3/1998 | Ohba et al. | 399/159 |
| 5,870,658 A | * | 2/1999 | Goto et al. | 399/284 |
| 5,893,014 A | * | 4/1999 | Goto et al. | 399/286 |
| 6,026,266 A | | 2/2000 | Sakai et al. | |
| 6,049,689 A | | 4/2000 | Ishii et al. | |
| 6,087,056 A | * | 7/2000 | Toyoshima et al. | 430/102 |
| 6,094,550 A | | 7/2000 | Kido et al. | |

FOREIGN PATENT DOCUMENTS

| | | | |
|---|---|---|---|
| JP | 7-31452 | | 5/1987 |
| JP | 7-31453 | | 5/1987 |
| JP | 10-307469 | | 11/1988 |
| JP | 63-303379 | * | 12/1988 |
| JP | 7-38093 | | 7/1989 |
| JP | 7-9552 | | 6/1991 |
| JP | 05-011512 | * | 1/1993 |
| JP | 05-165310 | * | 7/1993 |
| JP | 07-140779 | | 6/1995 |
| JP | 07-261412 | | 10/1995 |

* cited by examiner

*Primary Examiner*—Robert Beatty

(57) ABSTRACT

A copying machine consists of a photosensitive drum, a charging section, an exposure section, a developing section, a corona charging section, a cleaning section, a current removing section, and a fixing roller. In the developing section for carrying out a development by bringing a developing roller into contact with or bringing the developing roller close to a photosensitive layer, the following expression (1) has been established:

$$1 \leqq (td/\in d)/(tp/\in p) \leqq 8 \quad (1)$$

where $\in d$ and td ($\mu$m) represent a dielectric constant and a thickness of the dielectric layer respectively, and $\in p$ and tp ($\mu$m) represent a dielectric constant and a thickness of the photosensitive layer respectively.

7 Claims, 19 Drawing Sheets

(A case where a dielectric layer has a very high thickness)

IMAGE FORMING APPARATUS HAVING A SPECIFIC RELATIONSHIP OF THE DIELECTRIC CONSTANT AND LAYER THICKNESS FOR PHOTOCONDUCTOR AND DEVELOPER LAGERS

BACKGROUND OF THE INVENTION

1. Field of the Invention

The present invention relates to a developing apparatus that is used in an electronic photographing apparatus.

2. Description of Related Art

Conventionally, there have been broadly two types of developing systems, a two-component developing system and a one-component developing system, that are used for electronic photographing apparatuses such as copying machines.

The two-component developing system uses a developer that is a mixture of a carrier consisting of a magnetic material such as Fe (iron) or ferrite, and a toner. By changing a rate of a mixture of the carrier and the toner, the charging of the developer can be adjusted. This system is excellent in the developing characteristics of a fine line and a solid image and in the reproducibility of the gradation, and is also suitable for the formation of a color image.

On the other hand, the one-component developing system is a system that uses only a toner as a developer. According to this one-component developing system, it is not necessary to mix and stir a toner and a carrier. Further, this system has an advantage that it is not necessary to control the toner density and it is not necessary to exchange toners.

The one-component developing system is further divided into two systems of a system that uses a magnetic toner and a system that uses a non-magnetic toner. However, according to the system that uses a magnetic toner, the toner includes a magnetic powder. Therefore, this system is not suitable for forming a color image. As a result, the system using a non-magnetic toner has been mainly used as the one-component developing system.

According to a developing apparatus of the one-component developing system that uses a non-magnetic toner, a toner is electrostatically adhered to the surface of a developing roller, and this is brought close to a photosensitive drum, thereby to develop an electrostatic latent image. As a surf ace material f or the developing roller, a semiconductor or a dielectric unit has been used conventionally.

The use of a semiconductor developing-roller makes it possible to restrict an edge effect to a smaller level, and therefore, it is possible to prevent an unevenness of the density within the image pattern. However, it is difficult to set optionally and in high precision γ-characteristics that is largely affected by a resistance value, and thus, there is a drawback in that the gradation as a whole (the gradation in a solid image) is insufficient, and it is difficult to reproduce a fine line.

In the mean time, the use of a dielectric developing roller makes it possible to easily reproduce a fine line based on an edge effect. Therefore, it is easily possible to optionally set the γ-characteristics based on a dielectric layer. As a result, it is possible to form an image having a satisfactory gradation as a whole. However, because of the edge effect, unevenness in the density occurs easily within a pattern.

On the other hand, there has been disclosed in Japanese Patent Application Laid-open No. Hei 10-307469 an invention that improves the situation of an uneven density in an image in a developing apparatus that uses a dielectric developing roller, by changing a current-conductive elastic layer of the dielectric developing roller.

Further, in a developer using the dielectric developing roller, in order to form an image with a satisfactory reproduction of a fine line and in high gradation without easily generating a stain due to a scattering of a toner, it is necessary to set proper characteristics to the dielectric layer, the photosensitive drum and the toner respectively.

These characteristics have been disclosed in literatures, such as, for example, (A) Japanese Patent Publication No. Hei 7-31452, (B) Japanese Patent Publication No. Hei 7-31453, (C) Japanese Patent Publication No. Hei 7-9552, (D) Japanese Patent Publication No. Hei 7-38093, (E) Japanese Patent Application Laid-open No. Hei 7-261412, and (F) Japanese Patent Application Laid-open No. Hei 7-140779, respectively.

The literatures (A) and (B) describe a relationship between a dielectric constant and a resistivity in a dielectric layer. Further, the literature (C) describes a dielectric constant and a thickness in a dielectric layer, and the literature (D) describes a resistance and a thickness of a dielectric layer.

Further, the literature (E) describes a combination of a thickness of a dielectric layer and a volume average particle size of a toner. Further, the literature (F) describes a preferable relationship between a thickness of a dielectric layer and a thickness of a photosensitive layer of a photosensitive drum.

However, each of the above literatures takes into consideration characteristics of only two items from out of the dielectric layer, the photosensitive drum, and the toner. Therefore, developing apparatuses that are described in these literatures have not been able to form images that have satisfactory reproducibility of a fine line and satisfactory gradation.

SUMMARY OF THE INVENTION

In the light of the above-described conventional problems, it is, therefore, an object of the present invention to provide a developing apparatus that can form an image with high reproducibility of a fine line and in high gradation, by restricting an edge effect and a toner scattering to a minimum.

In order to achieve the above object, according to a first aspect of the present invention, there is provided a developing apparatus that is used in an electronic photographing apparatus, for carrying out a development by bringing a developing roller having a dielectric layer on its surface into contact with or bringing the developing roller close to a photosensitive layer, wherein the following expression (1) has been established:

$$1 \leqq (td/\in d)/(tp/\in p) \leqq 8 \quad (1)$$

where $\in d$ and td represent a dielectric constant and a thickness of the dielectric layer respectively, and $\in p$ and tp represent a dielectric constant and a thickness of the photosensitive layer respectively.

Further, according to a second aspect of the invention, there is provided a developing apparatus according to the first aspect, wherein the following expression (2) has been established instead of the expression (1):

$$1 \leqq (td/\in d)/(tp/\in p) \leqq 2 \quad (2)$$

Further, according to a third aspect of the invention, there is provided a developing apparatus that is used in an electronic photographing apparatus, for carrying out a development by bringing a developing roller having a dielectric layer on its surface into contact with or bringing the developing roller close to a photosensitive layer, wherein the following expression (3) has been established:

$$(tt/\in t)/2 \leqq (tp/\in p) \leqq (td/\in d) \quad (3)$$

where $\in d$ and td represent a dielectric constant and a thickness of the dielectric layer respectively, $\in p$ and tp represent a dielectric constant and a thickness of the photosensitive layer respectively, and $\in t$ and tt represent an apparent dielectric constant and a thickness of a toner layer formed on the dielectric layer respectively.

Further, according to a fourth aspect of the invention, there is provided a developing apparatus according to the third aspect, wherein the following expression (4) has been established instead of the expression (3):

$$(tt/\in t) \leqq (tp/\leqq p) \leqq (td/\in d) \quad (4)$$

Further, according to a fifth aspect of the invention, there is provided a developing apparatus that is used in an electronic photographing apparatus, for carrying out a development by bringing a developing roller having a dielectric layer on its surface into contact with or bringing the developing roller close to a photosensitive layer, wherein the following expression (5) has been established:

$$(tt/\in t) \leqq Ln(W/1.77)\cdot(tp/\in p)/1.73 \quad (5)$$

where $\in d$ and td represent a dielectric constant and a thickness of the dielectric layer respectively, $\in p$ and tp represent a dielectric constant and a thickness of the photosensitive layer respectively, $\in t$ and tt represent an apparent dielectric constant and a thickness of a toner layer formed on the dielectric layer respectively, and W represents a minimum recording width of an electrostatic latent image that is formed on a photosensitive drum.

Further, according to a sixth aspect of the invention, there is provided a developing apparatus according to the fifth aspect, wherein the following expression (6) has been established instead of the expression (5):

$$(td/\in d) \geqq (tp/\in p) \geqq 1.73\cdot(tt/\in t)/Ln\ (W/1.77) \quad (6)$$

Further, according to a seventh aspect of the invention, there is provided a developing apparatus that is used in an electronic photographing apparatus, for carrying out a development by bringing a developing roller having a dielectric layer on its surface into contact with or bringing the developing roller close to a photosensitive layer, wherein the following expression (7) has been established:

$$C > -0.204\cdot(Log(X))^2 + 0.737\cdot Log\ (X) + 1.29 \quad (7)$$

where $X=(td/\in d)/(tp/\in p)$ where $\in d$ and td represent a dielectric constant and a thickness of the dielectric layer respectively, and $\in p$ and tp represent a dielectric constant and a thickness of the photosensitive layer respectively, subject to a condition that $C=(Vo-VL)/Vo$, where C represents a contrast of a latent image potential, Vo represents a surface potential of a photosensitive unit in an unexposed area, and VL represents a surface potential of a photosensitive unit in an exposed area.

According to the above aspects of the present invention, it is possible to provide a developing apparatus that can restrict the edge effect and the scattering of a toner to a minimum and that can form an image with high reproducibility of a fine line and in high gradation.

DETAILED DESCRIPTION OF THE PREFERRED EMBODIMENTS

One embodiment of the present invention will be explained next.

A copying machine (hereinafter to be referred to as the present copying machine) relating to the present embodiment is an electronic photographing apparatus that uses a non-magnetic one-component toner. The present copying machine has a function of forming a toner image on a photosensitive drum, transferring this toner image onto a sheet, and outputting an image desired by a user, by an electronic photographing process that has processes of a current charging, an exposure, a developing, a transfer copying, a cleaning, a fixing, and removing a current.

The structure of the present copying machine will be explained first.

Figure 1:
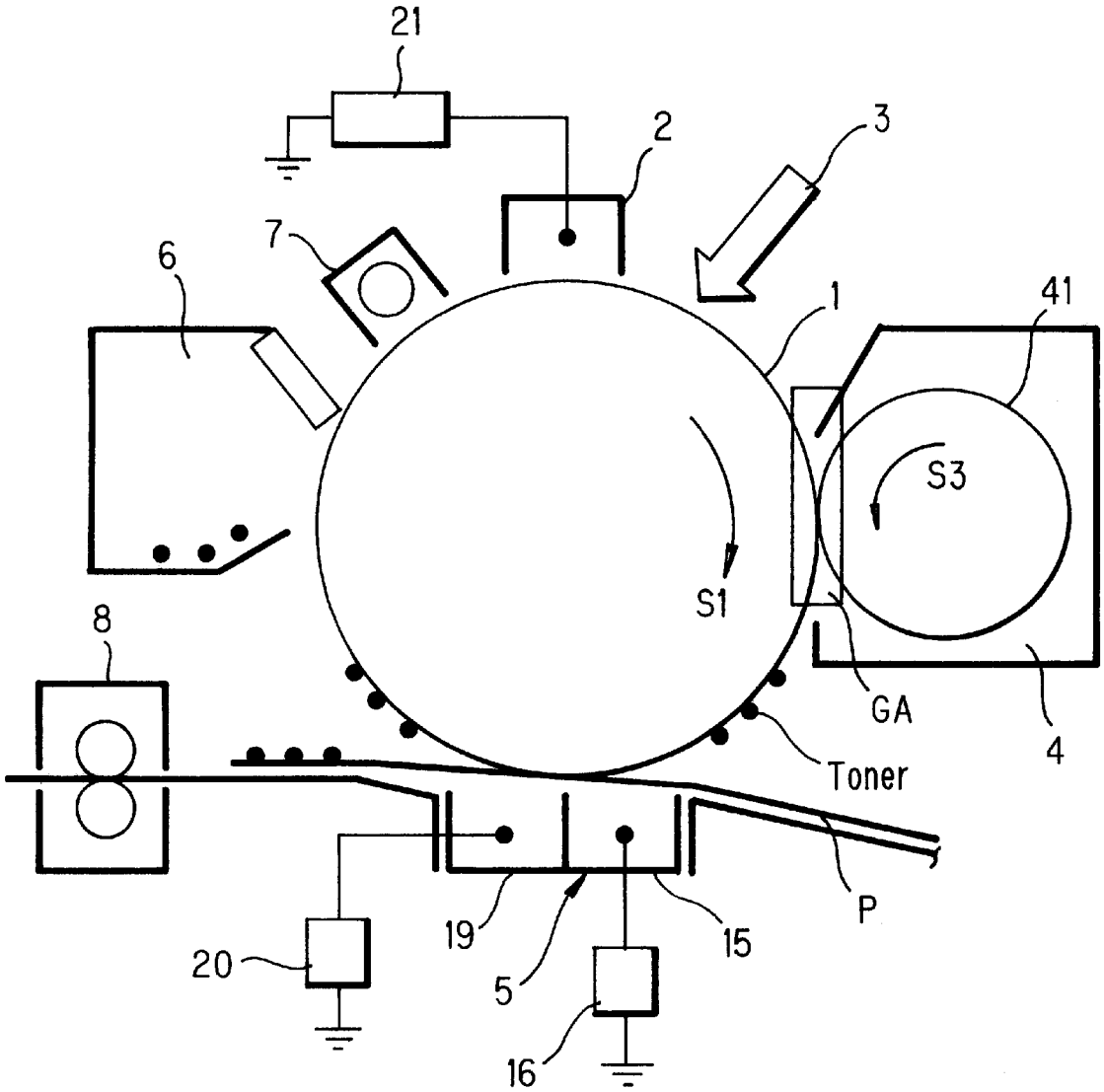
FIG. 1 is an illustrative view showing a structure of a copying machine relating to an embodiment of the present invention.

FIG. 1 is an illustrative view showing a structure of the present copying machine. As shown in FIG. 1, the present copying machine comprises a photosensitive drum 1, a charging section 2, an exposure section 3, a developing section 4, a corona charging section 5, a cleaning section 6, a current removing section 7, and a fixing roller 8.

The photosensitive drum 1 is provided to rotate in a direction of SI. The photosensitive drum 1 consists of a conductive substrate made of metal such as aluminum, and a photosensitive layer that is formed on the surface of the conductive substrate. The photosensitive layer comprises a carrier generation layer (CGL), and a carrier transit layer (CTL). The carrier transit layer is a relatively thin layer including polycarbonate and others, and this layer becomes an outermost layer of the photosensitive drum 1.

The charging section 2 is provided for the purpose of uniformly charging (in the negative polarity) the surface of the photosensitive drum 1 based on power supplied from a high-voltage power source 21. A corona charger, a contact roller charger and the like can be used for this charging section 2.

The exposing section 3 is provided for the purpose of forming an electrostatic latent image (electrostatic latent potential) according to image data onto the surface of the photosensitive drum 1 by exposing a laser beam onto the charged photosensitive drum 1. In other words, in the photosensitive drum 1, a positive electric charge generates from the carrier generation layer at an exposed portion, and a negative charge that has been given by the charging section 2 is canceled. Accordingly, an electrostatic potential relatively increases at the exposed portion, and an electrostatic latent image is formed there.

The developing section 4 is provided for the purpose of developing the electrostatic latent image of the photosensitive drum 1, and forming a toner image on the photosensitive drum 1. The developing section 4 is equipped with a developing roller 41 having a dielectric layer on the surface. The structure of the developing section 4 will be explained in detail later.

The corona charging section 5 is provided for the purpose of transferring a toner image onto a sheet of paper P supplied from a paper feeder not shown, and for discharging the paper to the fixing roller 8. The corona charging section 15 consists of a transfer section 15 and a separation section 19.

The transfer section 15 is provided for the purpose of contacting the sheet P carried to a predetermined transfer area with the toner image of the photosensitive drum 1, thereby transferring the toner image onto the sheet P. The sheet P is carried to the transfer area by a carrying member not shown, in synchronism with the rotation of the photosensitive drum 1.

In other words, the transfer section 15 is equipped with a high-voltage transfer power source 16. The transfer section 15 gives a positive charge, which is an opposite polarity to that of the toner, to the sheet P that has been carried to the transfer area, by corona discharging using the power of the power source 16. Thus, the sheet P is attracted by the photosensitive drum 1, and is transferred the toner image.

A charger of a charger type or a contact roller type equipped with a high-voltage power source, for example, can be used for the transfer section 15.

The separation section 19 is for separating the sheet P attracted by the photosensitive drum 1 from the photosensitive drum 1.

In other words, the separation section 19 is equipped with a separation power source 20 that is a high-voltage AC power source. The separation section 19 removes a current from the sheet P by an AC corona discharging using the power of this power source, thereby to make it possible to easily separate the sheet P from the photosensitive drum 1.

A separation claw not shown is provided at the downstream of the separation section 19. A sharp front end of this separation claw is contacted to the photosensitive drum 1. This separation claw is used to forcibly separate the sheet P from the photosensitive drum 1 that has not been able to be separated by only the removal of the current.

The fixing roller 8 is for fixing the toner image on the sheet P. The fixing roller 8 also has a function of discharging the sheet P to the outside of the present copying machine.

The cleaning section 6 is for cleaning the photosensitive drum 1 in order to recover the toner that remains on the photosensitive drum 1 after the toner image has been transferred. The toner that has been recovered by the cleaning section 6 is stored in a recovery section (not shown) within the cleaning section 6 in order to reutilize the recovered toner.

The current removing section 7 is for removing the charge of the photosensitive drum 1 after the remaining toner has been cleaned thereby to electrically initialize (setting to a zero potential) the photosensitive drum 1. An optical current-removing lamp, a contact current remover and the like can be used for the current removing section 7.

The structure of the developing section 4 that is a characteristic structure of the present invention will be explained next.

Figure 2:
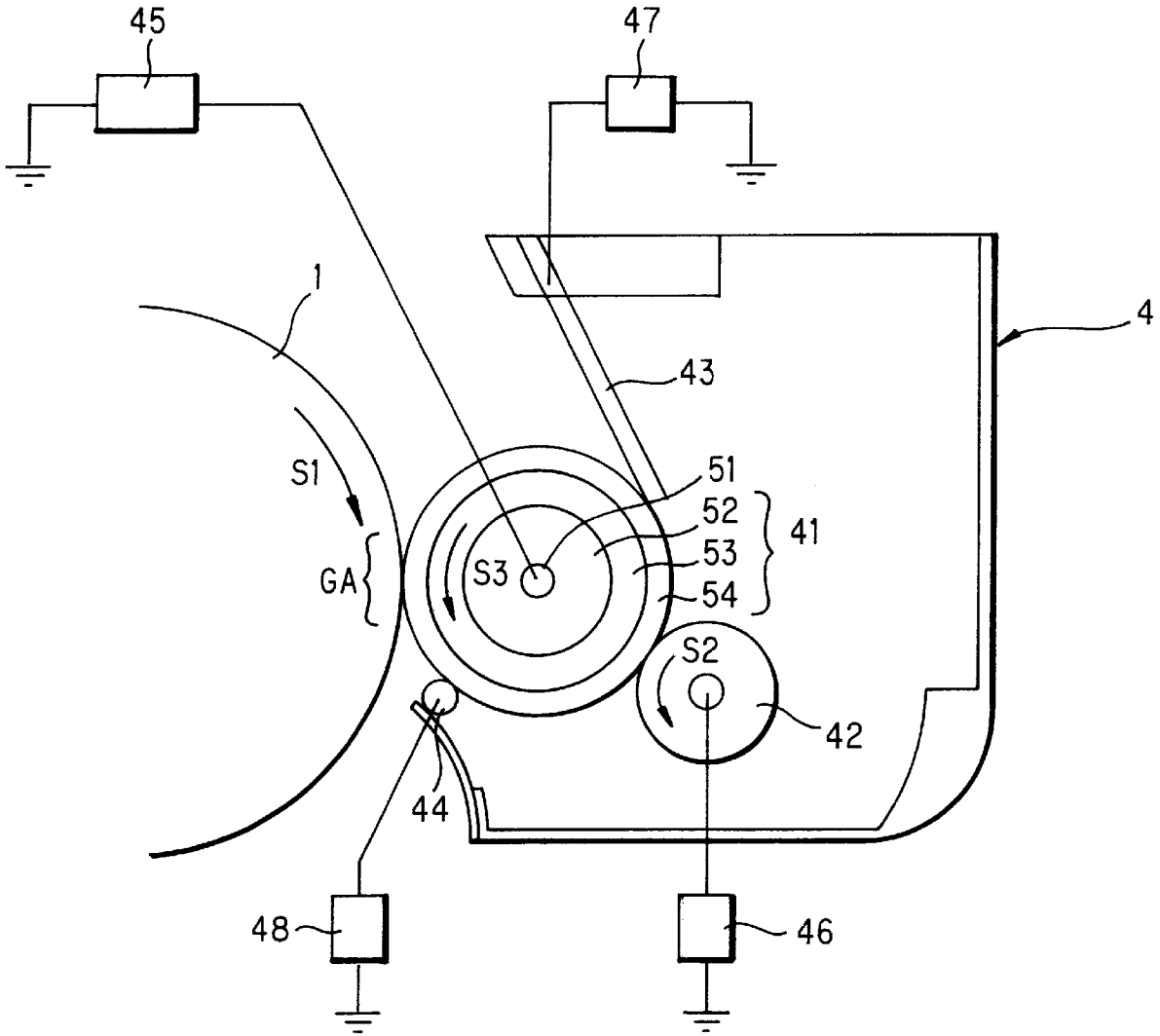
FIG. 2 is an illustrative view showing a structure of a developer.

FIG. 2 is an illustrative view showing the structure of the developing section 4. As shown in FIG. 2, the developing section 4 includes a toner supply roller 42, a blade 43, and a current removing brush 44, in addition to the above-described developing roller 41.

Further, the developing section 4 includes a developing power source 45 that gives a developing bias voltage −250 V to each of these members 41 to 44, a toner supply power source 46 that gives a supply bias voltage −350 V, a blade power source 47 that gives a blade bias voltage −350 V, and a current-removing power source 48.

The toner supply roller 42 is a roller made of a current-conductive sponge. The toner supply roller 42 is applied with a supply bias by the toner supply power source 46, and attracts and holds the toner (a particle size 7 to 8 mm) within the developing section 4. The toner supply roller 42 has a function of forming a toner layer onto a dielectric layer 54 of the developing roller 41 while rotating (in the direction of S2) by keeping contact with the developing roller 41 in a state of holding the toner.

The blade 43 has a function of restricting the toner layer formed on the dielectric layer 54 to a predetermined thickness (10 to 15 $\mu$m) and increasing the potential of the toner layer to a predetermined value based on a friction charging and a blade bias.

The current removing brush 44 has a function of preventing the developing roller 41 and the toner from being charged too much, by removing the current from a portion of the developing roller 41 that has passed through a developing area GA by applying a current-removing bias from the current-removing power source 48.

The developing roller 41 has a core metal layer 52, a resistance layer 53 and a dielectric layer 54 laminated in this order around a rotation axis 51.

The rotation axis 51, the core metal layer 52 and the resistance layer 53 are made of metal and conductive rubber respectively, to form a substrate of the developing roller 41. The dielectric layer 54 is made of a dielectric such as an epoxy resin or a polyester resin, and is being applied with a developing bias voltage supplied from the developing power source 45.

The toner supplied from the toner supply roller 42 is electrostatically adhered to the dielectric layer 54, which is set to rotate in a direction of S3 in a state that the dielectric layer 54 is brought close to the photosensitive drum 1. The dielectric layer 54 has a function of adhering the toner to an electrostatic latent image on the photosensitive drum 1 in the developing area GA (reference FIG. 1), developing this electrostatic latent image, and forming a toner image.

The characteristics of the dielectric layer 54 in the charge on the developing roller 41 are set to within a range shown by the following expression (1), preferably within a range shown by the expression (2), based on the characteristics of the photosensitive layer of the photosensitive drum 1 shown in FIG. 1.

$$1 \leqq (td/\in d)/(tp/\in p) \leqq 8 \quad (1)$$

$$1 \leqq (td/\in d)/(tp/\in p) \leqq 2 \quad (2)$$

where $\in$d and td are symbols that represent a dielectric constant and a thickness ($\mu$m) of the dielectric layer respectively, and $\in$p and tp are symbols that represent a dielectric constant and a thickness ($\mu$m) of the photosensitive layer respectively.

Further, the characteristics of the dielectric layer 54 may be set to within a range shown by the following expression (3), preferably within a range shown by the expression (4), based on the characteristics of the photosensitive layer and the toner.

$$(tt/\in t)/2 \leqq (tp/\in p) \leqq (td/\in d) \quad (3)$$

$$(tt/\in t) \leqq (tp/\in p) \leqq (td/\in d) \quad (4)$$

where $\in$t and tt are symbols that represent an apparent dielectric constant and a thickness ($\mu$m) of a toner layer formed on the dielectric layer 54 respectively.

Further, the characteristics of the dielectric layer 54 may be set to within a range shown by the following expression (5), preferably within a range shown by the expression (6), based on the characteristics of the photosensitive layer and the toner and a minimum recording width W of an electrostatic latent image formed on the photosensitive layer.

$$(tt/\in t) \leqq Ln(W/1.77)\cdot(tp/\in p)/1.73 \quad (5)$$

$$(td/\in d) \geqq (tp/\in p) \geqq 1.73\cdot(tt/\in t)/Ln\ (W/1.77) \quad (6)$$

where W is a symbol that represents a minimum recording width ($\mu$m) of the electrostatic latent image, and Ln is a symbol that represents a natural number.

As explained above, when the dielectric constant and the thickness of the dielectric layer 54, the photosensitive layer and the toner layer respectively are set to within the range shown by the expression (1) or (3), it is possible to prevent the toner scattering and to restrict the variation in the latent image electric field within the pattern due to the edge effect, thereby to form a stable image.

Further, when the dielectric constant and the thickness of the dielectric layer 54, the photosensitive layer and the toner layer respectively are set to within the range shown by the expression (5), it is possible to restrict the variation in the latent image electric field very effectively.

Further, when the dielectric constant and the thickness of the dielectric layer 54, the photosensitive layer and the toner layer respectively are set to within the range shown by the expression (2) or (4) or (6), it is possible to prevent the toner scattering and to restrict the variation in the latent image electric field very effectively.

Next, reasons why the ranges of the dielectric field and the thickness of the dielectric layer 54 in the present copying machine are set to the above-described expressions (1) to (6) will be explained.

Figure 3A:
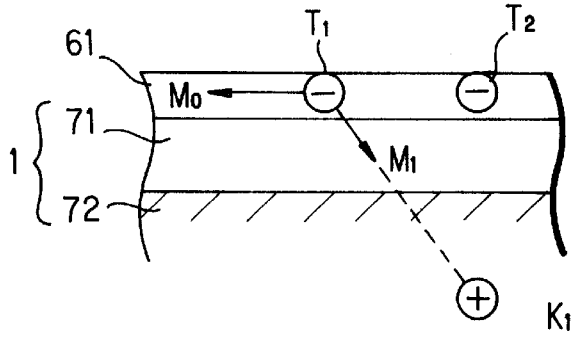
FIG. 3A to FIG. 3C are illustrative views showing a relationship between an electric field that works on a toner on a toner layer and a thickness of a dielectric layer when the toner layer of a developing roller comes close to a photosensitive drum that comprises a photosensitive layer and a current-conductive substrate.
Figure 3B:
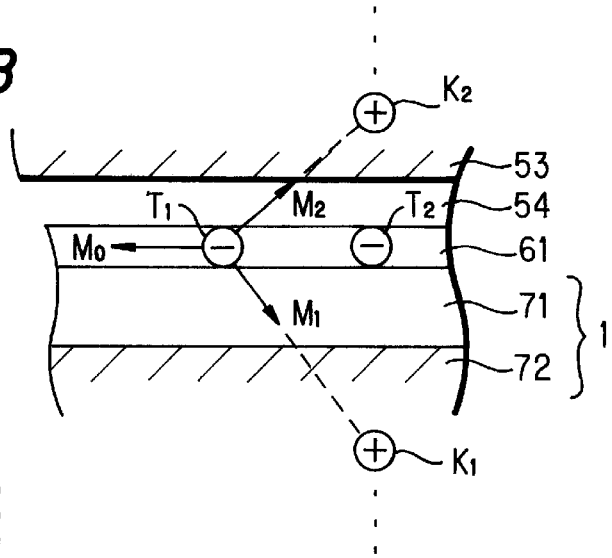
Figure 3C:
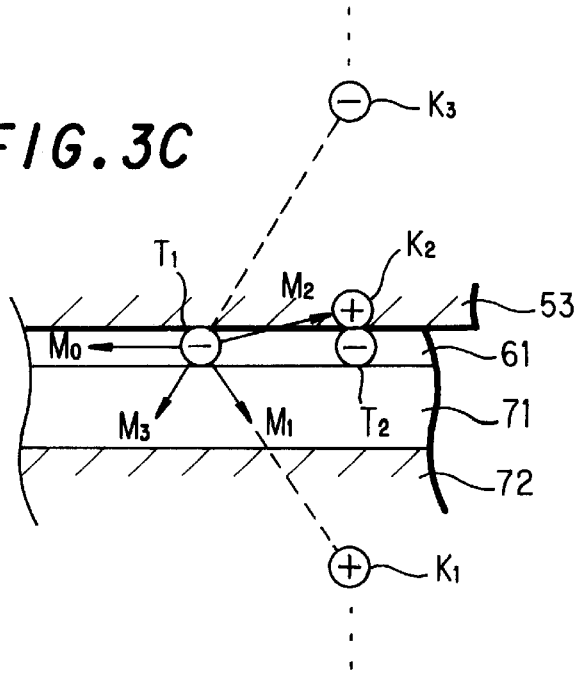

First, the mutual operation of the toner in the toner layer will be explained. FIG. 3A to FIG. 3C are illustrative views showing a relationship between an electric field that works on the toner on the toner layer 61 and the thickness of the dielectric layer 54 when the toner layer 61 of the developing roller 41 comes close to the photosensitive drum 1 that comprises the photosensitive layer 71 and current-conductive substrate 72.

To simplify the explanation, it is assumed that there are two toners T1 and T2 having a negative load in the toner layer 61 in these drawings.

In the following expression, the thickness of each of the dielectric layer 54, the toner layer 61 and the photosensitive layer 71 is expressed as a value of the thickness divided by the dielectric constant. In other words, they are expressed as (td/$\in$d), (tt/$\in$t), and (tp/$\in$p) respectively.

As shown in FIG. 3B, in this case, it is considered that the toner T1 receives an electric field M0 from the toner T2, and at the same time, receives electric fields M1 and M2 and their high-order electric fields (not shown) from primary mirror image charges K1 and K2 of the toner T2 generated within the conductive substrate 72 and the resistance layer 53.

Further, as shown in FIG. 2 and 3A, when the dielectric layer 54 is very thick, the distance between the toner layer 61 and the resistance layer 53 becomes sufficiently large. Therefore, the influence of the mirror image charge K2 generated within the resistance layer 53 becomes negligibly small. On the other hand, as shown in FIG. 3C, when the dielectric layer 54 does not exist, it is considered that the toner T1 receives the electric fields M0 to M2 and their high-order electric fields. As one example of a high-order electric field, an electric field M3 is generated from a mirror image charge K3 generated within the resistance layer 53. This mirror image charge K3 is a mirror image of the mirror image charge K1, and is a secondary mirror image charge of the toner T2.

As explained above, the electric fields that the toner T1 receives change according to the thickness of the dielectric layer 54.

Figure 4:
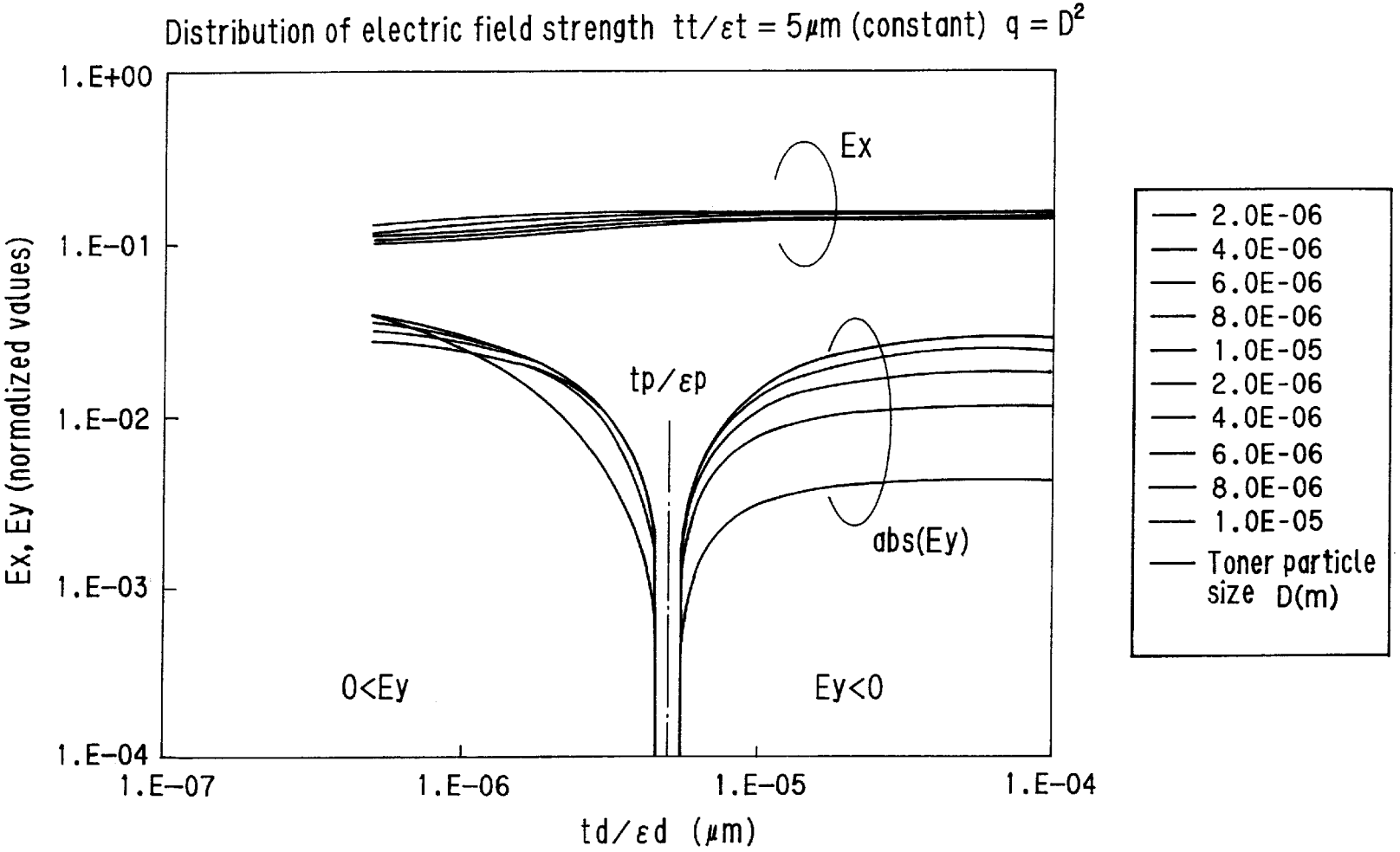
FIG. 4 is a graph that shows a result of a simulation (simulation 1) carried out to obtain a relationship between a thickness td ($\mu$m) of a dielectric layer, a thickness ta ($\mu$m) of a space, and electric fields Ex and Ey (toner electric fields) that each toner on the toner layer receives, by variously changing the particle size of the toner, based on a fact that an electric field is obtained by superimposing electric fields of surrounding charges.

FIG. 4 is a graph that shows a result of a simulation (simulation 1) carried out to obtain a relationship between the thickness td ($\mu$m) of the dielectric layer 54 (FIGS. 2, 3), the thickness ta ($\mu$m) of the space, and electric fields Ex and Ey (toner electric fields) that each toner on the toner layer 61 (FIGS. 2, 3) receives, by variously changing the particle size of the toner, based on a fact that an electric field is obtained by superimposing electric fields of surrounding charges.

In this simulation 1, it has been assumed that the toner of equal particle sizes is filled in the toner layer 61 without a space, and that the distance between adjacent particles of the toner is equal to the toner particle size. Further, as a result of measuring the toner charge quantity, the charge quantity is −20($\mu$C/g) when the toner particle size is 9 ($\mu$m), and the charge quantity is −45 ($\mu$C/g) when the toner particle size is 4 ($\mu$m). Basically, the saturation charge quantity of the toner particles is proportional to the surface area based on the dielectric strength on the toner particle surface, that is, a charge quantity q per one toner particle is proportional to the second power of the particle size. From this fact, it has been assumed that the charge quantity q is proportional to the second power of a toner particle size D. Further, the calculation has been carried out by assuming that the photosensitive layer 71 has a thickness tp=15 ($\mu$m), the photosensitive layer 71 has a dielectric constant $\in$p=3, the toner layer 61 has a thickness tt=5($\mu$m), and the toner layer 61 has a dielectric constant $\in$p≈1.

Further, in the graph shown in FIG. 4, the horizontal axis shows the thickness (td/$\in$d) of the dielectric layer 54, and the vertical axis shows two components of the toner electric field, that is, the size of the electric field component Ey (the direction of the photosensitive layer 71 is negative) in a direction perpendicular to the dielectric layer 54 and the size of the electric field component Ex in a direction parallel with the dielectric layer 54.

As shown in this graph, the electric field Ex has a substantially constant size regardless of (td/$\in$d). On the other hand, the electric field Ey becomes smaller as (tp/$\in$p) takes a larger thickness. It can be known that when (tp/$\in$p) becomes the same size as the thickness (tp/$\in$p) of the photosensitive layer 71, the electric field Ey becomes zero, and when (tp/$\in$p) takes a larger thickness, the electric field Ey becomes a negative value. In this graph, absolute values of the electric field Ey are shown to simplify the explanation.

Figure 5:
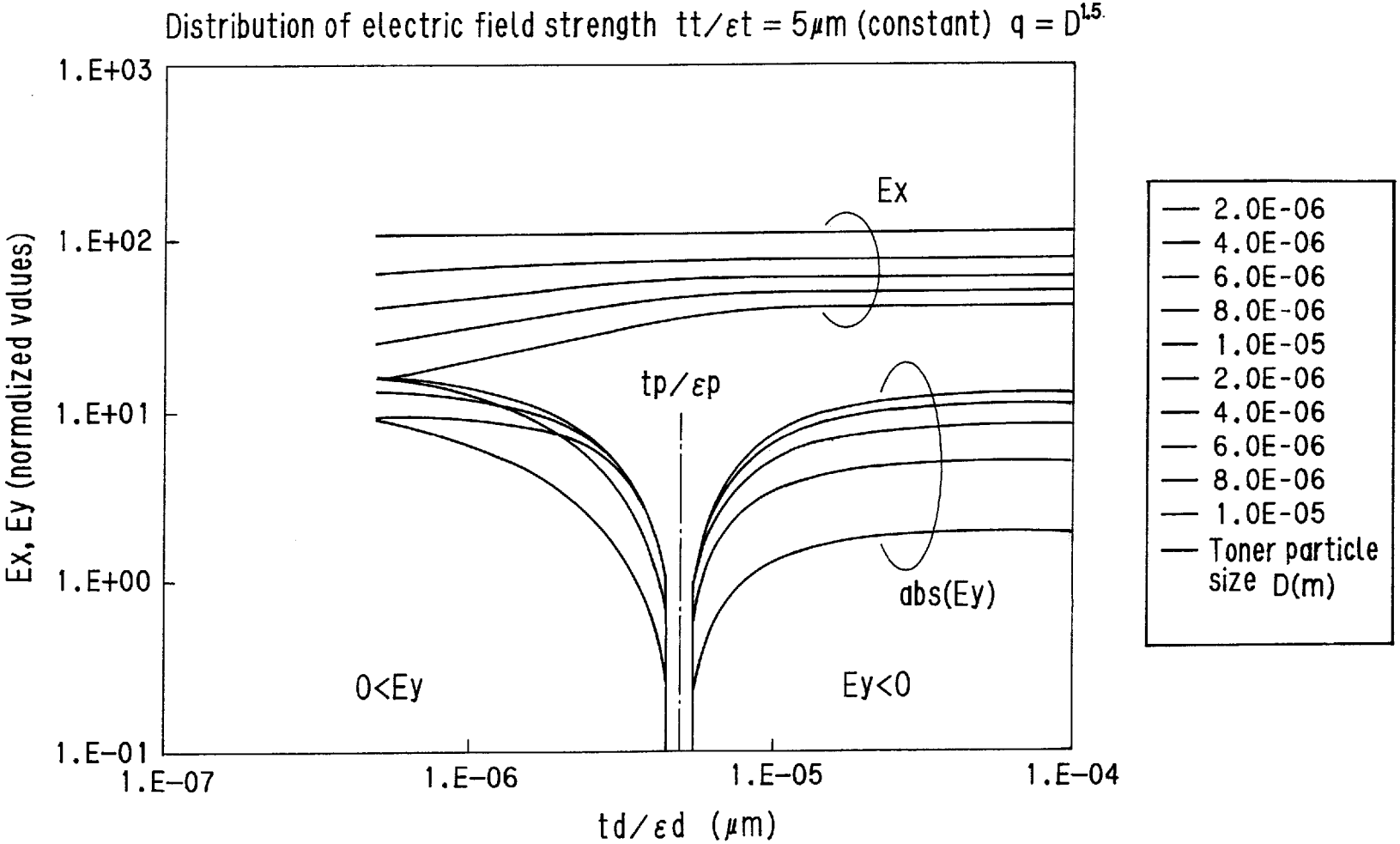
FIG. 5 is a graph that shows a result of a simulation similar to that of the above simulation carried out, based on the assumption that the thickness of the toner layer is 1.5 times the particle size of the toner and that the charge of each toner is proportional to the toner particle size.
Figure 6:
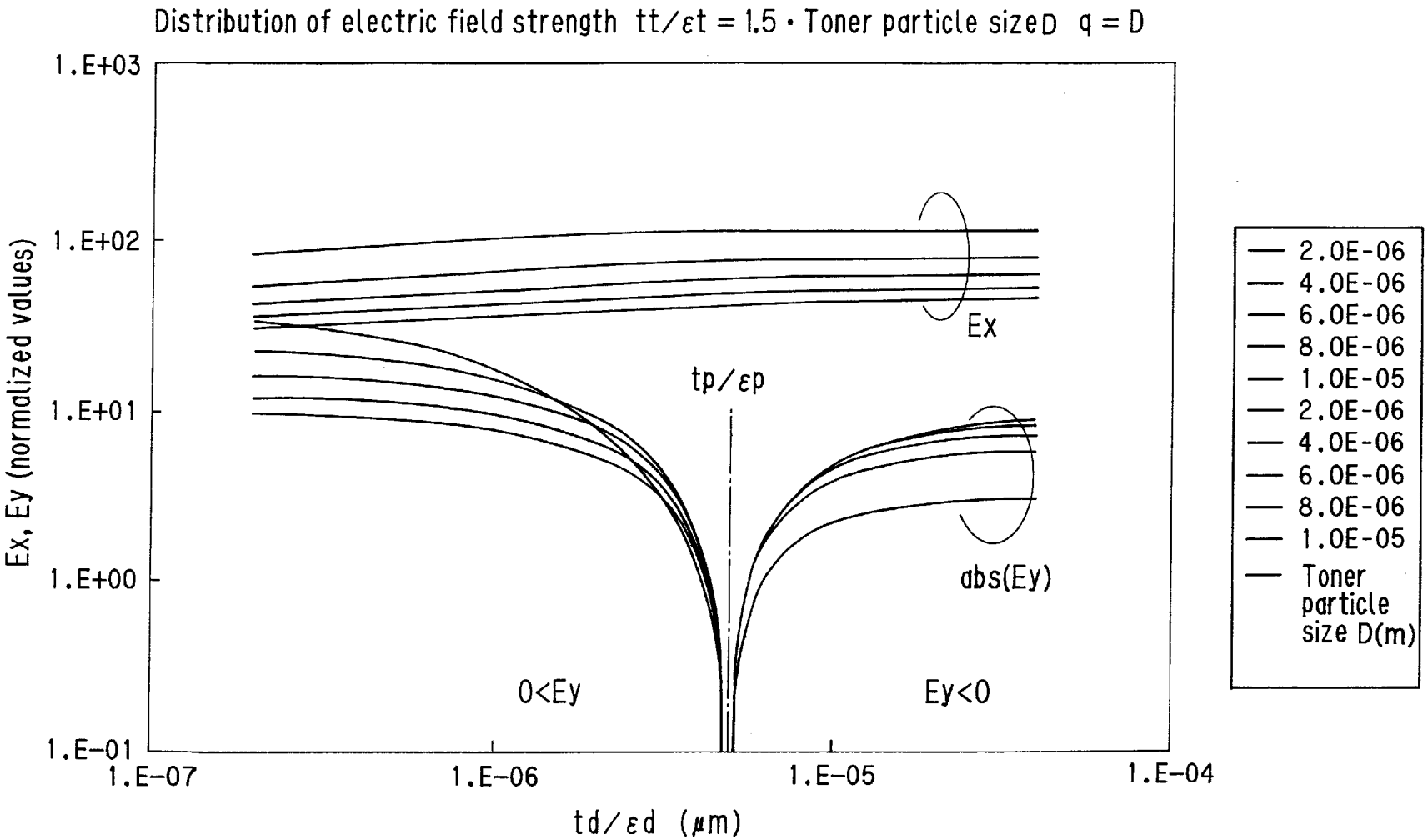
FIG. 6 is a graph that shows a result of a simulation carried out under similar conditions to those of the simulation shown in FIG. 5.

FIG. 5 is a graph that shows a result of a simulation similar to that of the above simulation carried out, based on the assumption that the charge of the toner is proportional to 1.5 times the particle size of the toner. FIG. 6 is a graph that shows a result of a simulation similar to that of the above simulation carried out, based on the assumption that the thickness of the toner layer 61 is 1.5 times the particle size of the toner and that the charge of the toner is proportional to the particle size of the toner. As shown by these graphs, it can be known that even when the thickness of the toner layer 61 has changed, the electric field Ey keeps a similar trend to that of the result shown in FIG. 4, and is dependent on (td/$\in$d).

As explained above, when (td/$\in$d) takes a smaller value of thickness than (tp/$\in$p), in a developing nip section, the electric field Ey takes a positive value regardless of the thickness of the toner layer 61. Therefore, in the developing nip section and its vicinity, the charge of the toner on the toner layer 61 becomes in a state that the toner by itself is pulled to the side of dielectric layer 54. Therefore, when the developing bias is applied so as to develop only the exposed portion, the toner that faces the exposed portion is attracted in a scattered state to the exposed portion in the space section before rushing into the developing nip section. This attraction in the scatted state is accelerated by the developing bias, and this becomes the cause of the scattering.

On the other hand, when (td/$\in$d) takes a larger value of thickness than (tp/$\in$p), the electric field Ey takes a negative value regardless of the thickness of the toner layer 61. Therefore, the charge of the toner on the toner layer 61 becomes in a state that the toner by itself is pulled by the photosensitive layer 71. Therefore, when the developing bias is applied so as to develop only the exposed portion, the attraction of the toner facing to the exposed portion in a scattered state to the exposed portion in the space section before rushing into the developing nip can be restricted by the developing bias, and this is preferable.

Therefore, it is preferable that (td/$\in$d) takes a larger value than (tp/$\in$p), that is, it is preferable that the following expression is established.

$$(td/\in d) \geqq (tp/\in p) \quad \text{(a)}$$

The above explains the case of a study based on the assumption that the charge quantity q per one toner particle is proportional to approximately the second power of the toner particle size D, or that the charge quantity q per one toner particle is proportional to approximately 1.5 power of the toner particle size D or is proportional to the toner particle size D, in order to reduce the load of the photosensitive unit at the time of obtaining high quality of an image based on a substantial reduction in the size of toner particle (for example, from 9 $\mu$m to 4 $\mu$m). A study has also been carried out for the case based on the assumption that the charge quantity q per one toner particle is constant regardless of the toner particle size D. In this case, a trend similar to that obtained in the above has also been obtained, and it has been confirmed that it is preferable to meet the expression (a) without being constrained by the relationship between the charge quantity q per one toner particle and the toner particle size D.

Figure 7:
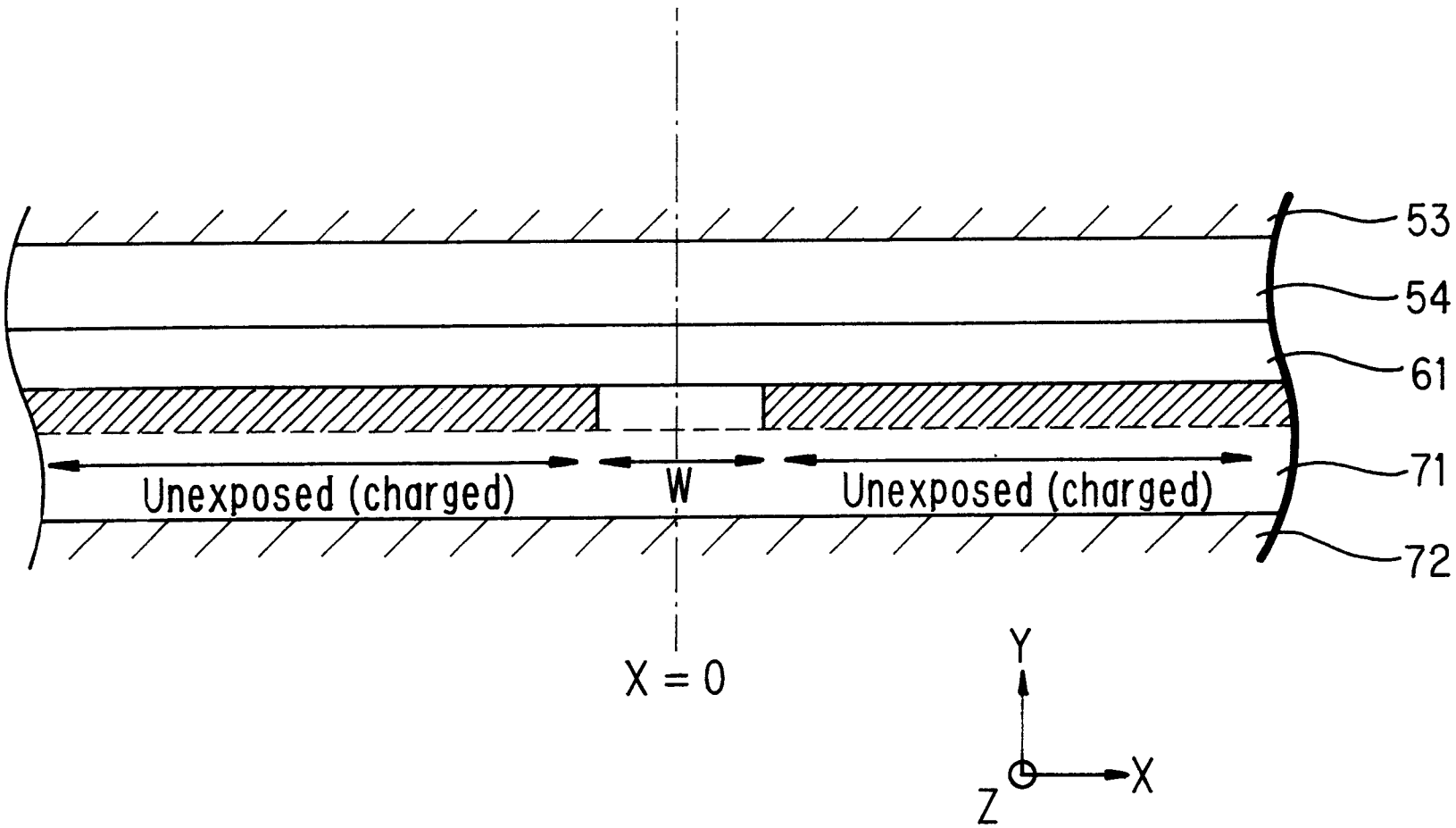
FIG. 7 is an illustrative view showing a state that an electrostatic latent image has been formed on a photosensitive layer.
Figure 8:
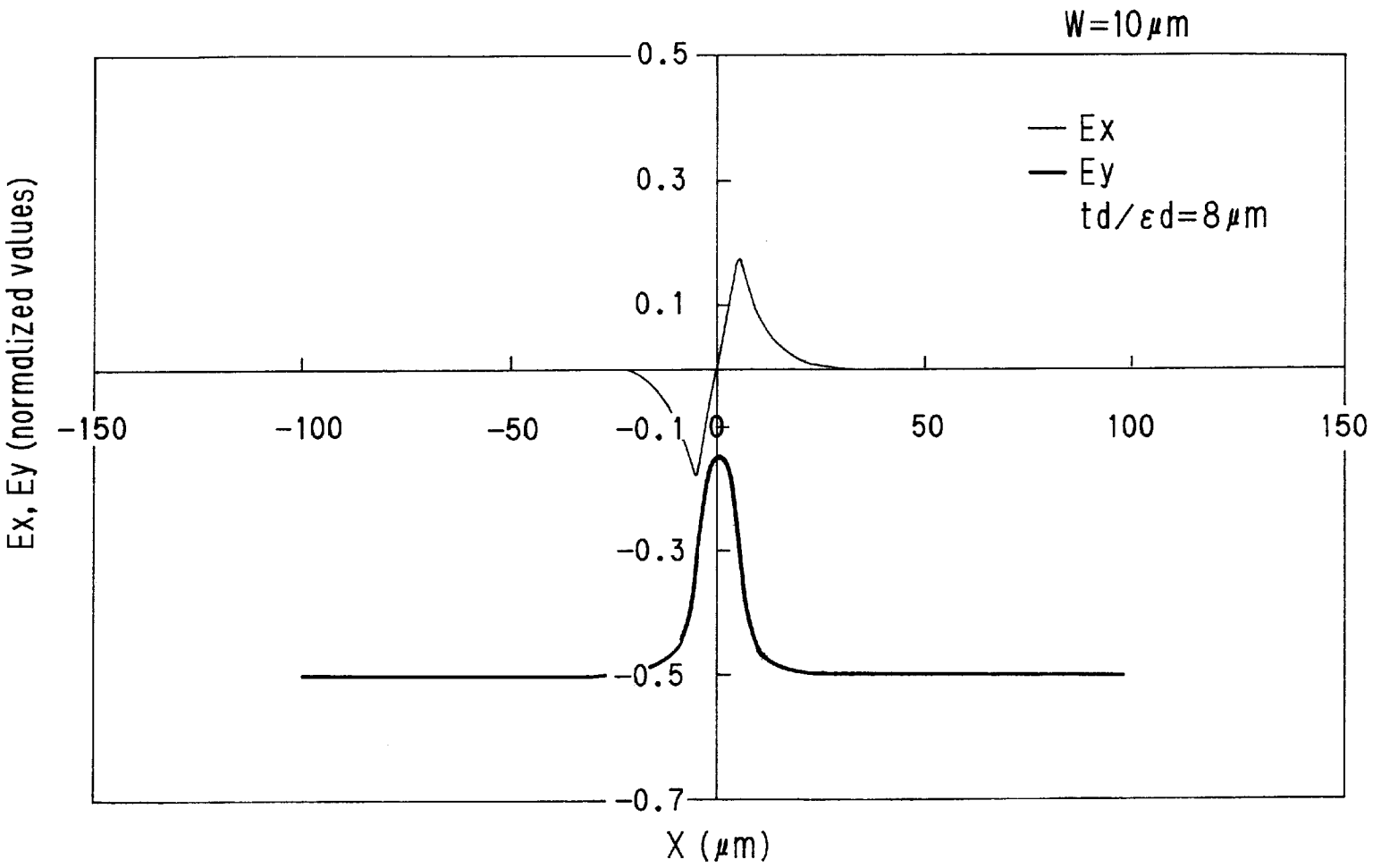
FIG. 8 is a graph that shows a result of a simulation carried out to obtain a relationship between electric fields Ex and Ey that a toner on a toner layer receives from a photosensitive layer and a position of the toner.
Figure 9:
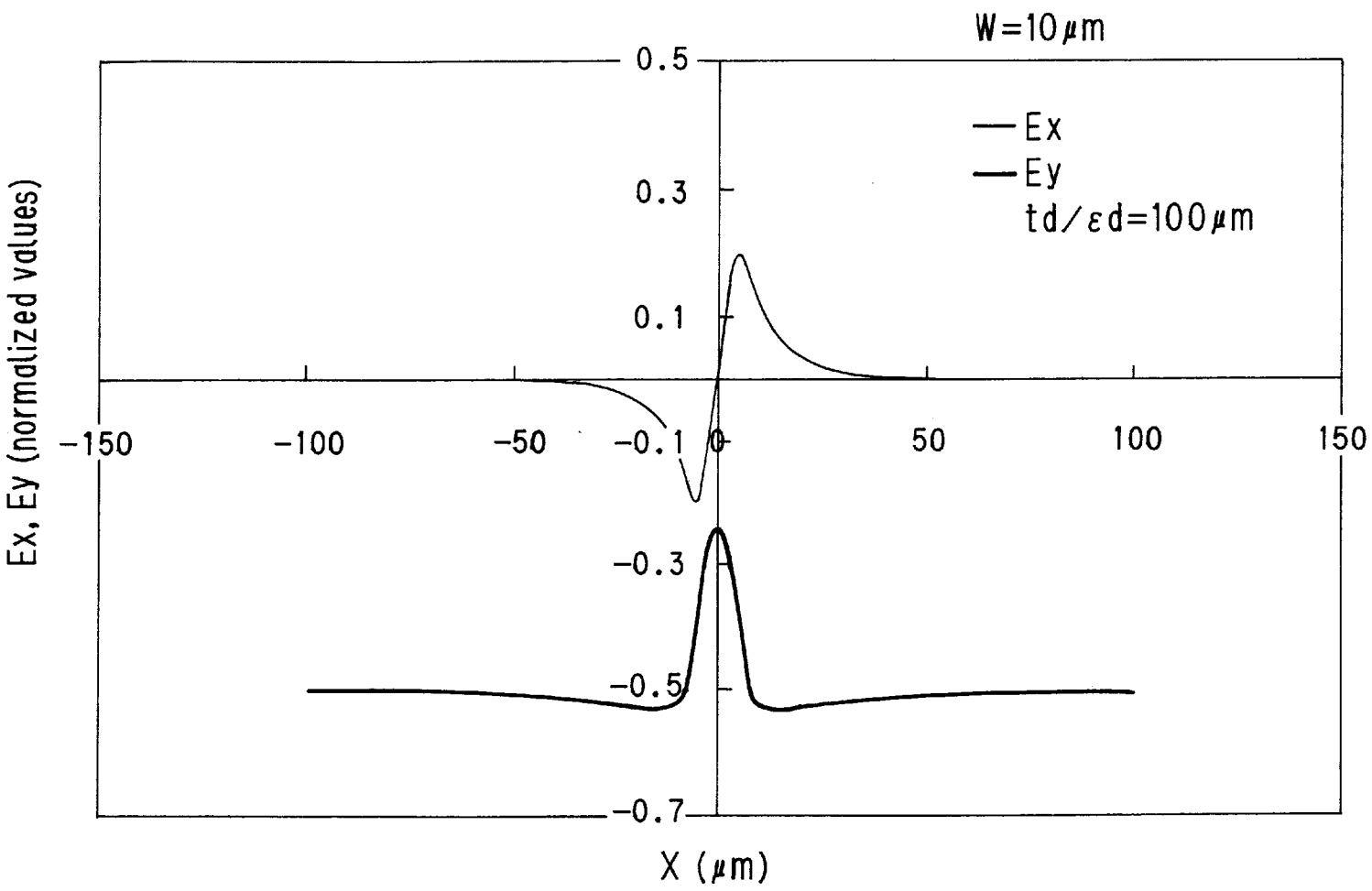
FIG. 9 is a graph showing a result of a similar simulation carried out.
Figure 10:
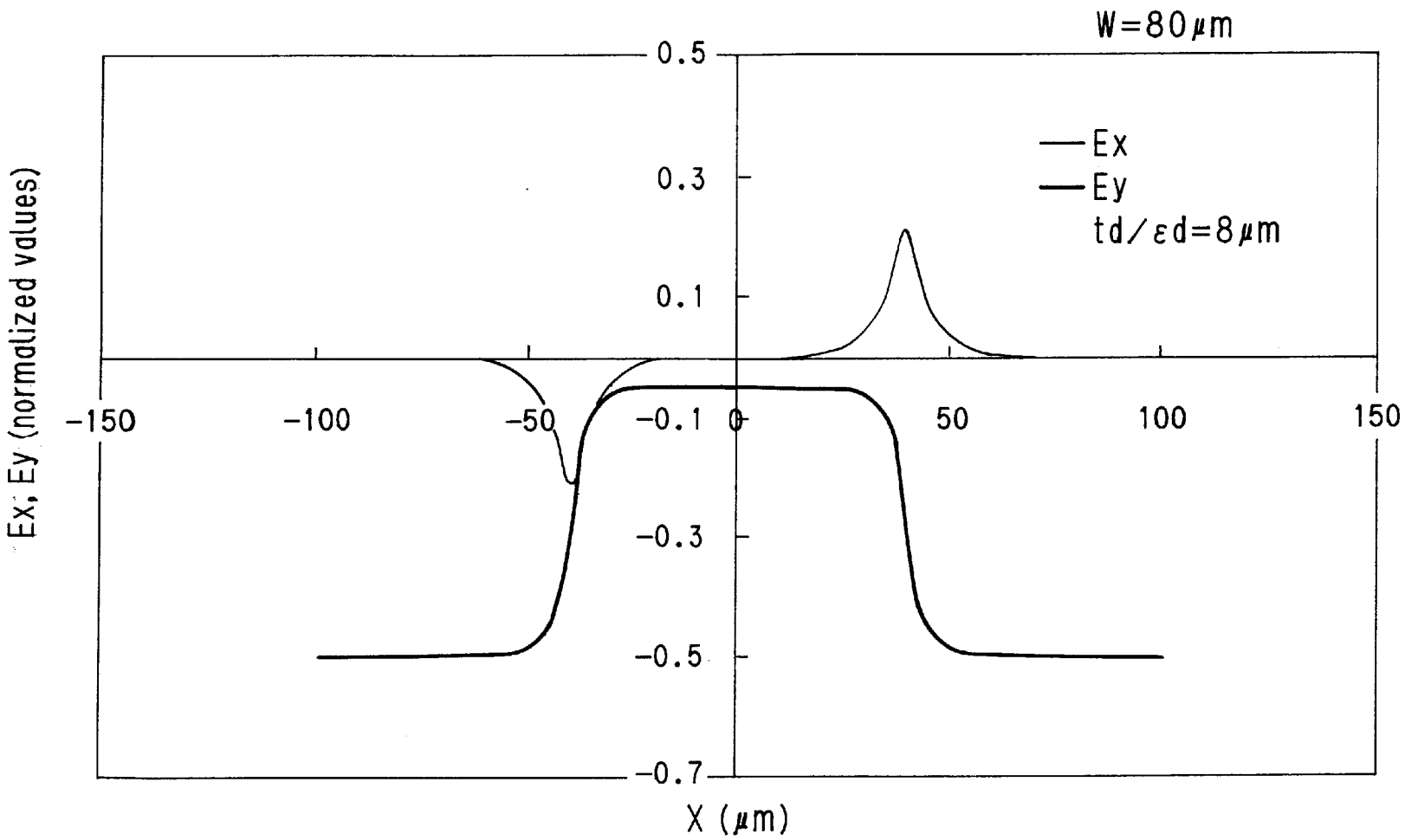
FIG. 10 is a graph showing a result of a similar simulation carried out.
Figure 11:
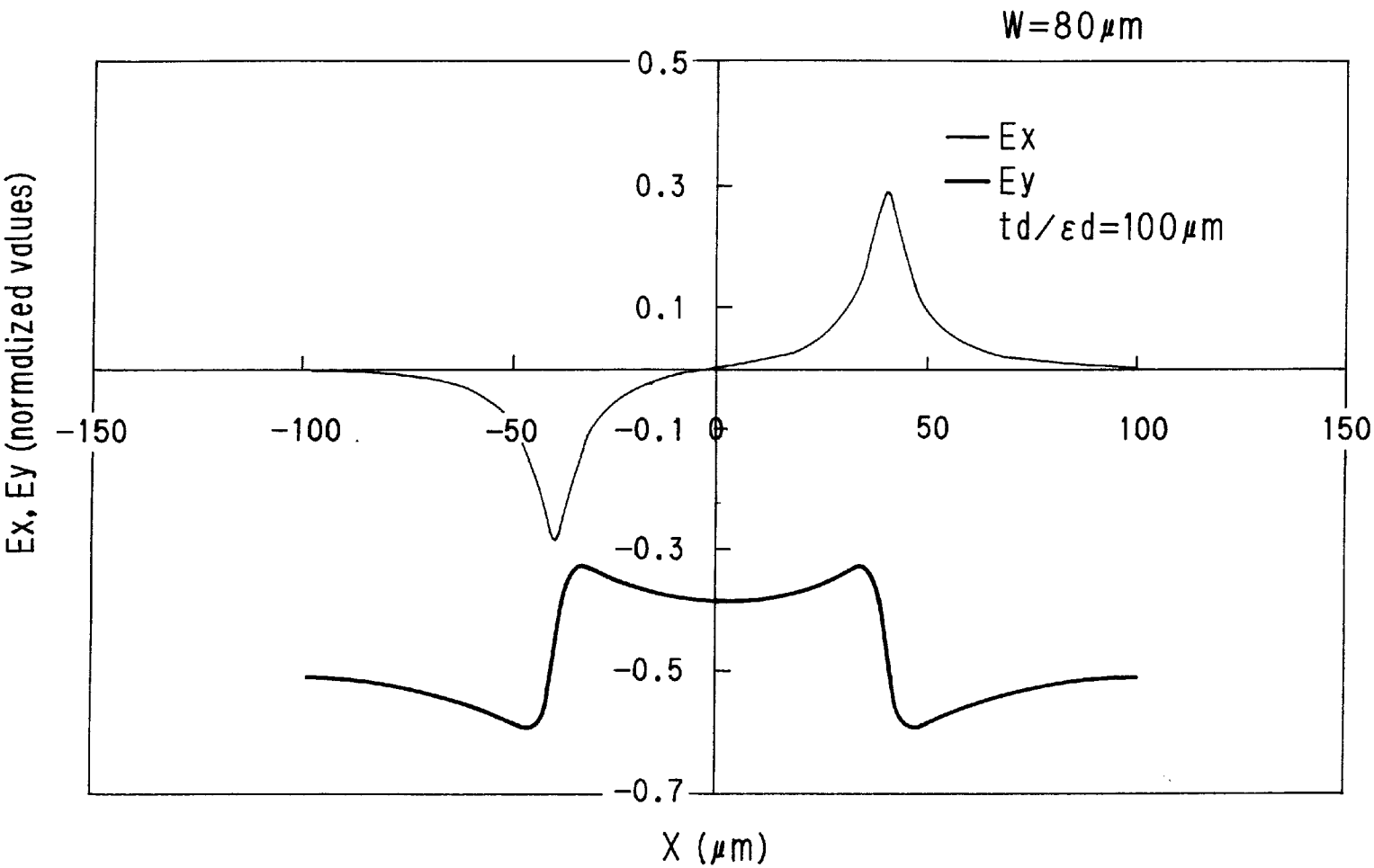
FIG. 11 is a graph showing a result of a similar simulation carried out.
Figure 12:
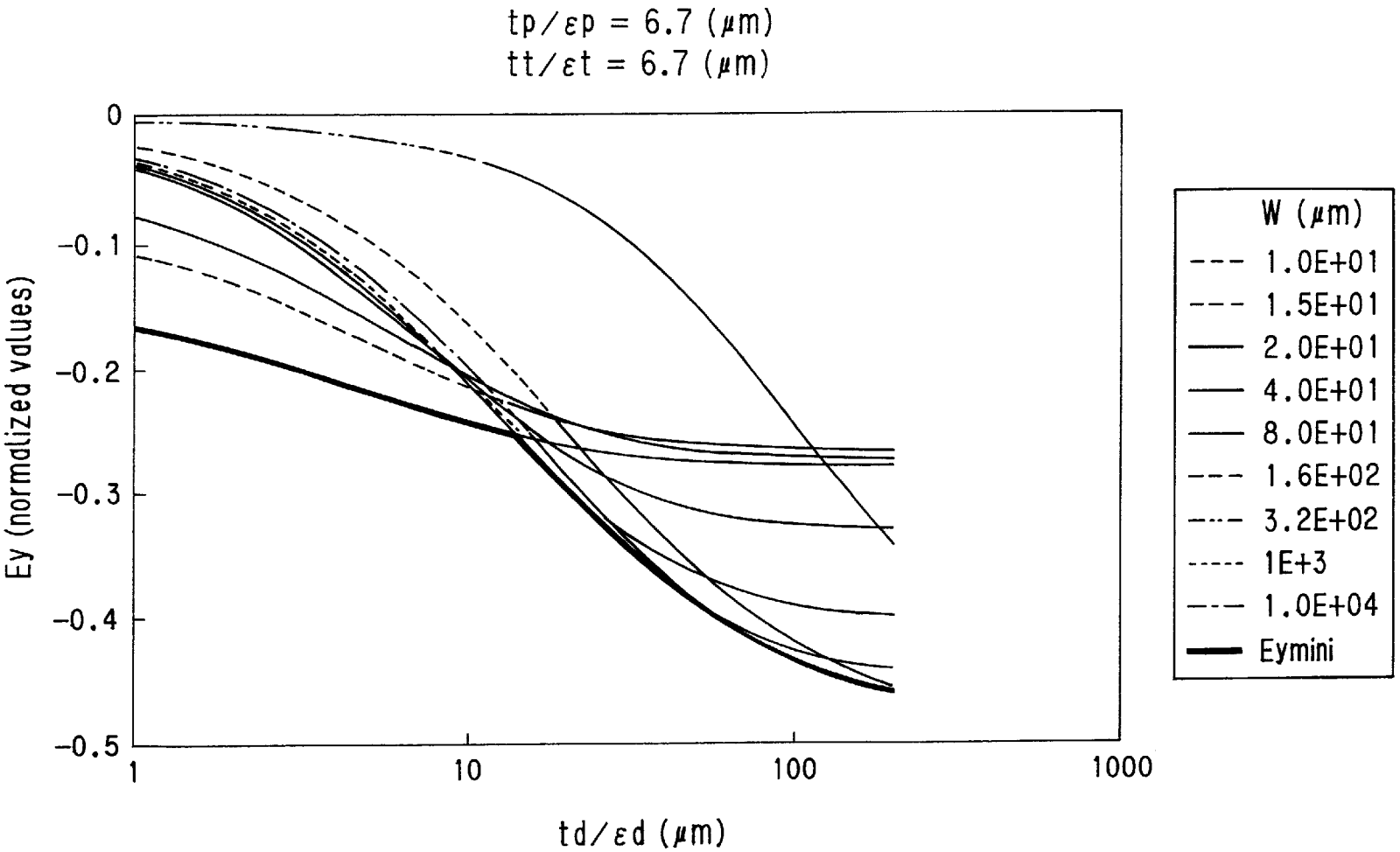
FIG. 12 is a graph that shows a result of a simulation (simulation 2) carried out to obtain a relationship between an electric field Ey in a vertical direction that a toner positioned at x=0 receives from a photosensitive layer and a thickness ($td/\in d$) of a dielectric layer, by variously changing a size W.

Next, the influence of the electrostatic latent image given to the toner will be explained. FIG. 7 is an illustrative view showing a state that an electrostatic latent image has been formed on the photosensitive layer 71. As shown in FIG. 7, when the uniformly charged photosensitive layer 71 has been exposed, the exposed portion is formed with an electrostatic latent image having a minimum line width W, and the potential of this portion is lowered.

FIG. 8 to FIG. 11 are graphs each of which shows a result of a simulation carried out to obtain a relationship between the electric fields Ex and Ey that the toner on the toner layer 61 receives from the photosensitive layer 71 and the position of the toner.

The minimum size of the line width W and the thickness (td/∈d) of the dielectric layer 54 are different between the graphs. As shown in these graphs, the electric field Ey takes a maximum value at a point of x=0.

Further, a simulation (simulation 2) has been carried out to obtain a relationship between the electric field Ey in a vertical direction that the toner positioned at x=0 receives from the photosensitive layer 71 and the thickness (td/∈d) of the dielectric layer 54, by variously changing the size W.

FIG. 12 to FIG. 16 are graphs that show a part of the result of the simulation. The thickness (tp/∈p) of the photosensitive layer 71 and the thickness (tt/∈t) of the toner layer 61 are different between these graphs.

In these graphs, the electric field Ey is standardized so that the electric field Ey becomes −0.5 when a latent image has not been formed on the photosensitive layer 71. As shown in these graphs, the value of the electric field Ey becomes smaller as (td/∈d) becomes larger, and the toner is not easily attracted to the exposed portion.

Figure 13:
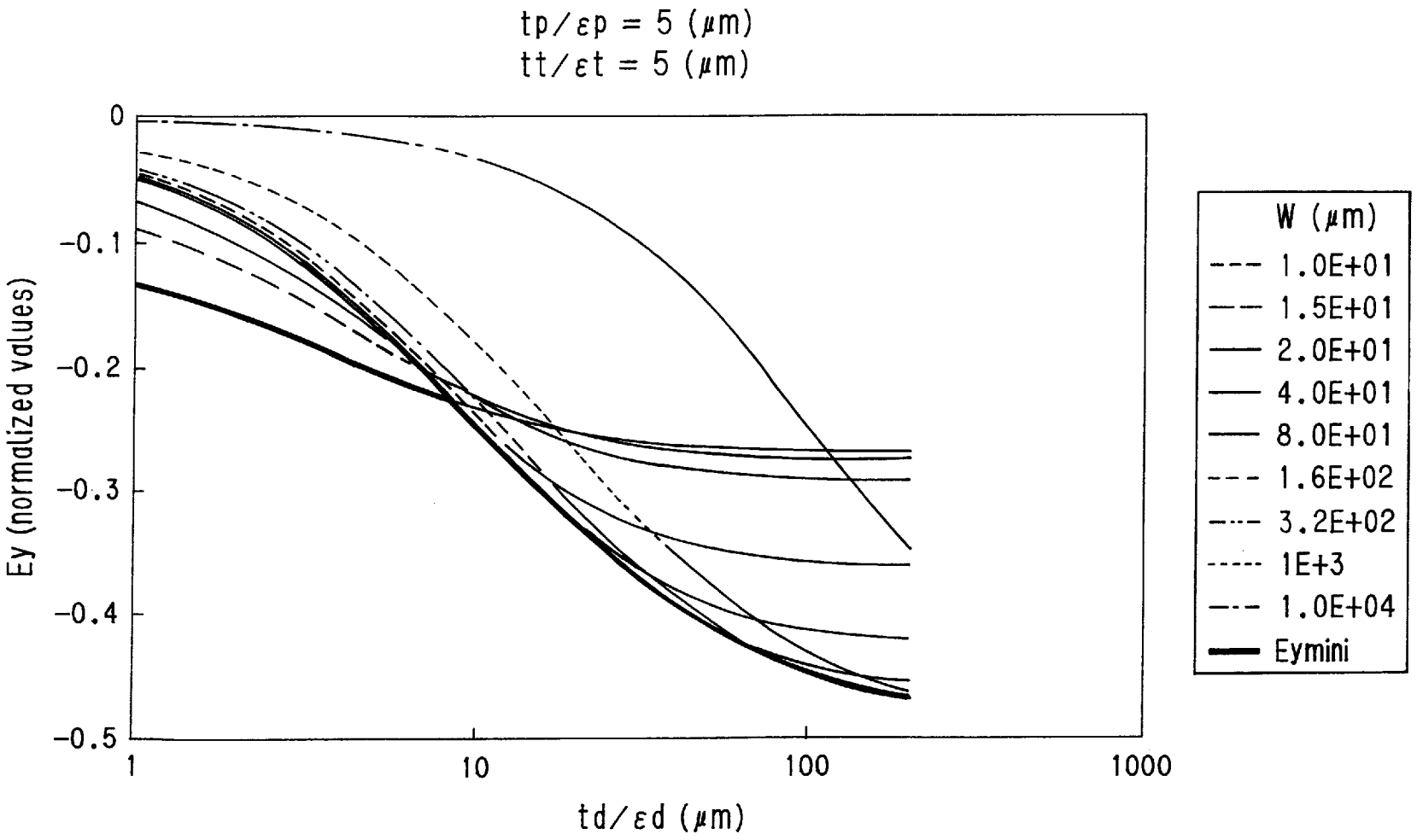
FIG. 13 is a graph showing a result of a similar simulation carried out.
Figure 14:
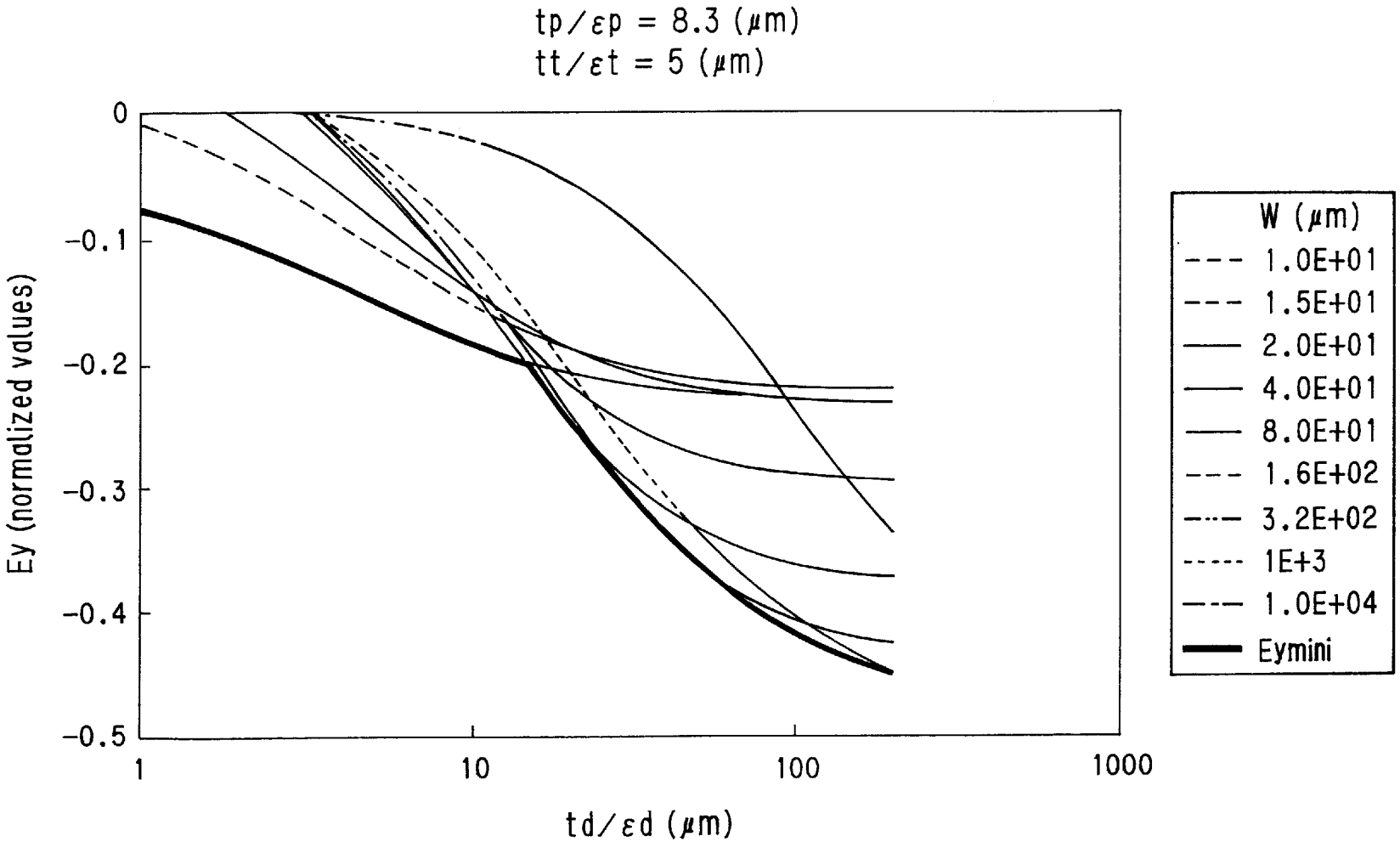
FIG. 14 is a graph showing a result of a similar simulation carried out.
Figure 15:
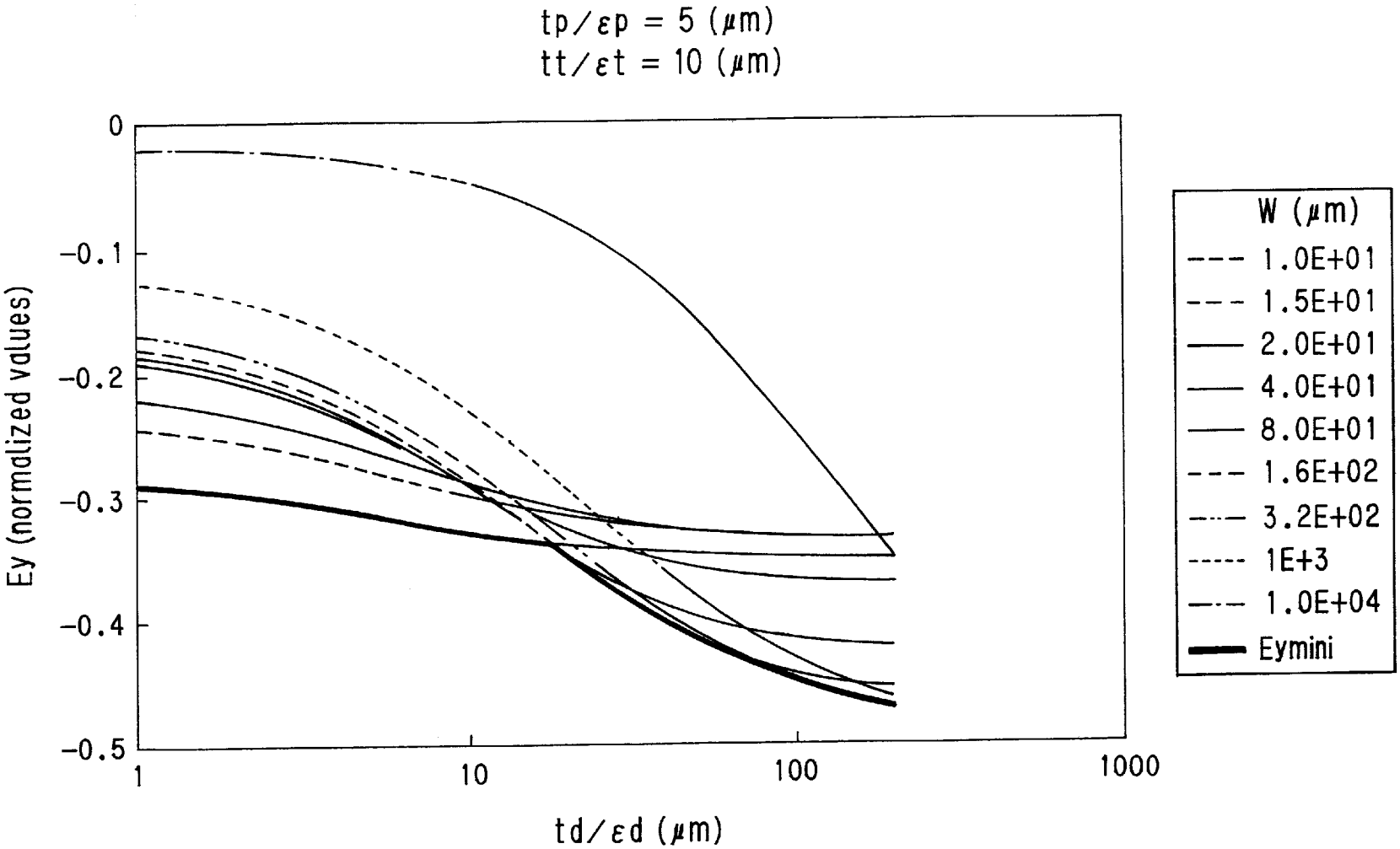
FIG. 15 is a graph showing a result of a similar simulation carried out.
Figure 16:
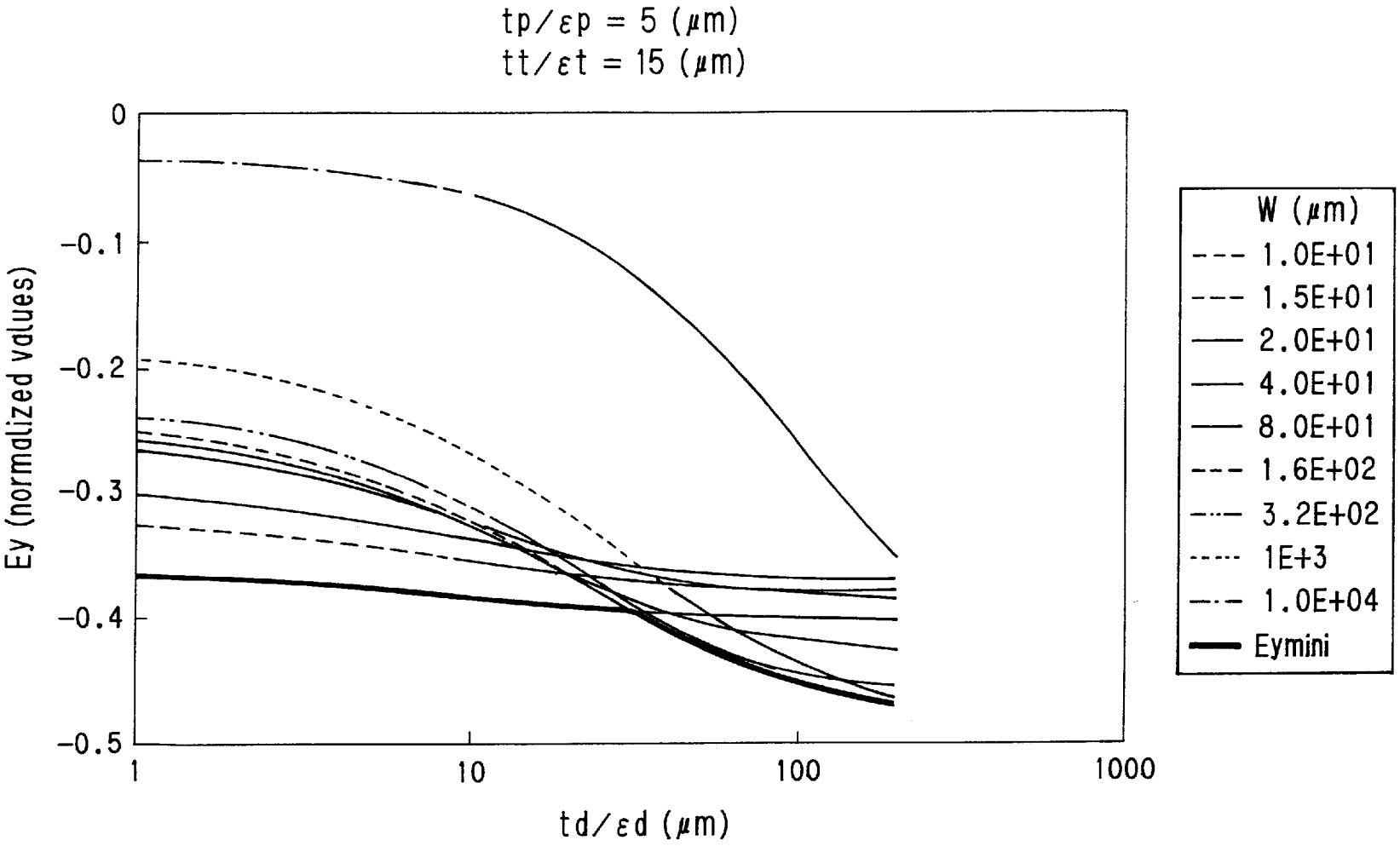
FIG. 16 is a graph showing a result of a similar simulation carried out.

Next, curves that take a minimum value of the electric field Ey are mutually connected to a form curve Eymini (a curve shown by a thick line in FIG. 13).

Figure 17:
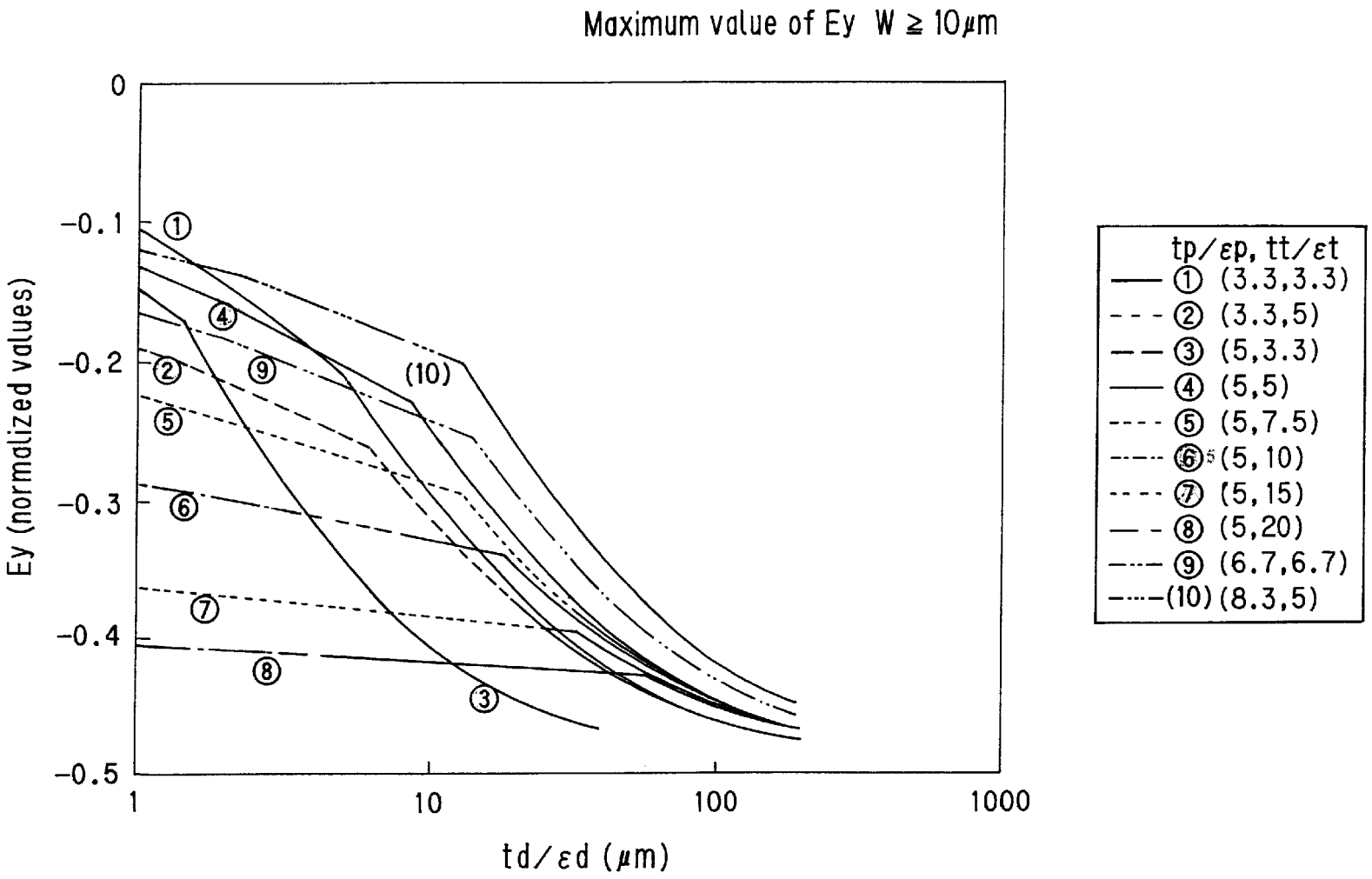
FIG. 17 is an illustrative view that shows curves Eymini by plotting the curves in one graph.

FIG. 17 is an illustrative view that shows curves Eymini by plotting these curves in one graph. In this graph, each curve is based on numbers represented by (n, m). This shows that each curve is obtained based on n (μm) representing (tp/∈p) and m (μm) representing (tt/∈t).

For values of (tp/∈p), there are 3.3 (μm), 5 (μm), 6.7 (μm), and 8.3 (μm). Further, for values of (tt /∈t), there are 3.3 (μm), 5 (μm), 6.7 (μm), 7.5 (μm), 10 (μm), 15 (μm), and 20 (μm).

Figure 18:
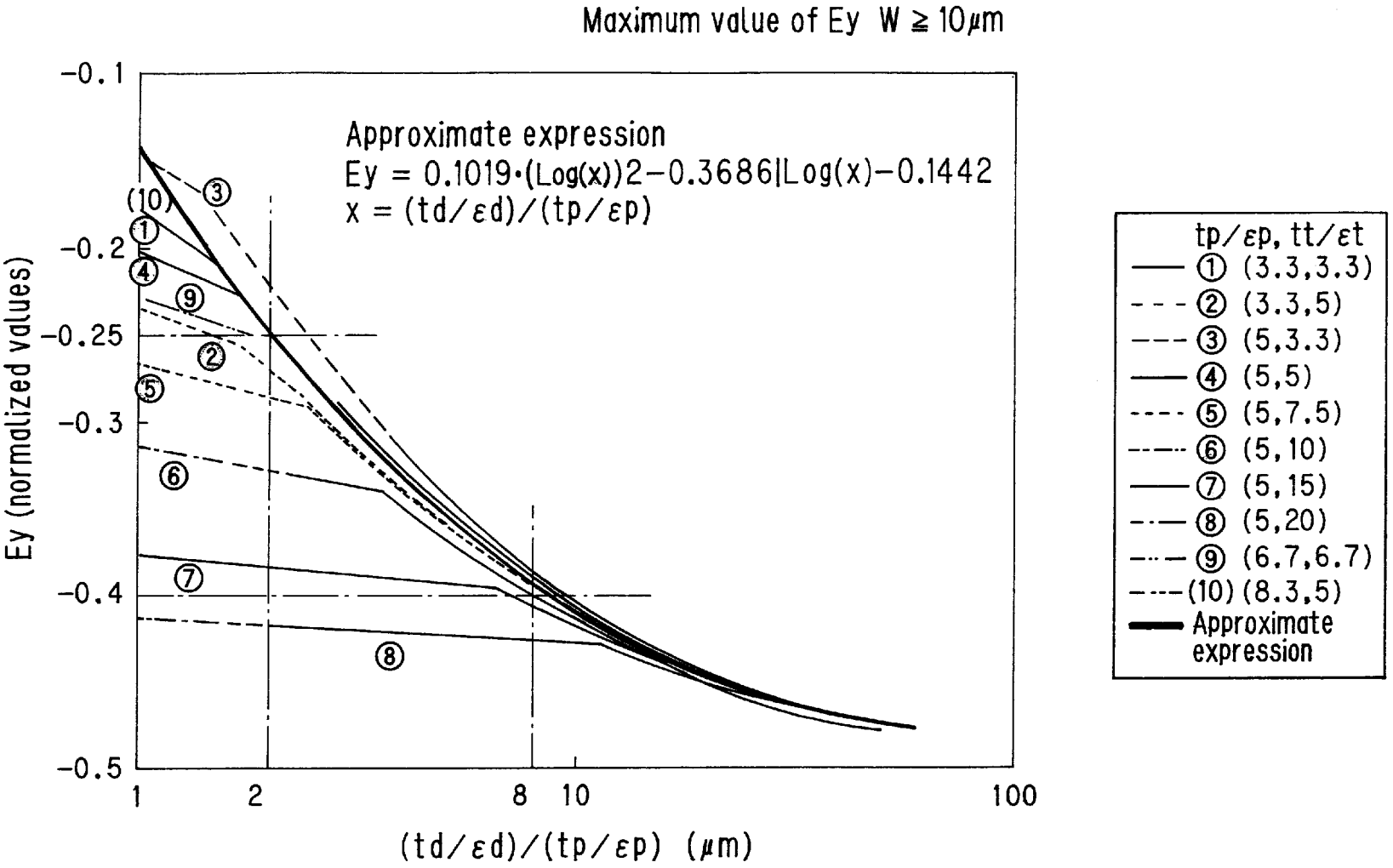
FIG. 18 is a graph that shows a result of dividing curves Eymini shown in FIG. 17 by ($tp/\in p$) and normalizing the horizontal axis.

FIG. 18 is a graph that shows a result of dividing the curves Eymini shown in FIG. 17 by (tp/∈p) and normalizing the horizontal axis. In other words, the horizontal axis of this graph is (td/∈d)/(tp/∈p).

No correlation is observed between the curves shown in FIG. 17. However, as shown in FIG. 18, the curves are approximated in one approximate curve based on the thickness of the dielectric layer (td/∈d)/(tp/∈p) normalized. Thus, an approximate expression that summarizes curves [1] to [10] can be obtained as follows.

$$Ey = 0.102\cdot(\mathrm{Log}(X))^2 - 0.369\cdot\mathrm{Log}(X) - 0.144 \quad (f)$$

where X=(td/∈d)/(tp/∈p).

When a relationship of C=(Vo∈VL)/Vo is given where C represents a contrast of a latent image potential, Vo (V) represents a surface potential of a photosensitive unit in an unexposed area, and VL (V) represents a surface potential of a photosensitive unit in an exposed area (an ideal latent image potential contrast C=1 when the potential of the unexposed portion has become completely zero by exposure), it has been required that the latent image potential contrast is at least 0.2 when a variation factor other than the latent image is taken into consideration. In other words, in the simulation 2, it is preferable that the size of the electric field Ey is ∈0.4 or above.

In the approximate expression curve (f) that summarizes the curves [1] to [10] shown in FIG. 18, when the size of the electric field Ey is −0.4 or above, the range of (td/∈d)/(tp/∈p) is approximately 8 or below. Therefore, it is preferable that the following expression is established.

$$(td/\in d)/(tp/\in p) \leqq 8 \quad (b)$$

Further, in general, when the latent image potential contrast is 0.5 or above, it becomes possible to carry out the adhesion of the toner to only the exposed portion very stably. As a result, it becomes possible to suppress the edge effect very effectively. In other words, it is more preferable that the size of the electric field Ey is −0.25 or above in the simulation 2.

In the approximate expression curve (f) that summarizes the curves [1] to [10] shown in FIG. 18, when the size of the electric field Ey is −0.25 or above, the range of (td/∈d)/(tp/∈p) is approximately 2 or below. Therefore, it is preferable that the following expression is established.

$$(td/\in d)/(tp/\in p) \leqq 2 \quad (c)$$

The curves shown in FIG. 18 can be broadly classified into three groups as follows.

A group A where (tp/∈p) is larger than (tt/∈t): [3], and [10]

A group B where (tp/∈p) is equal to (tt/∈t): [1], [4] and [9]

A group C where (tp/∈p) is smaller than (tt/∈t): [2], [5], [6], [7] and [8]

As shown in FIG. 18, the absolute value of the size of the electric field Ey in the group B is smaller than that in the group C, and the absolute value of the size of the electric field Ey in the group A is smaller than that in the group B. It is understood that it is preferable that the absolute value of the size of Ey is smaller. In other words, it can be understood that it is preferable that the size of (tp/∈p)/(tt/∈t) is larger.

Further, it can be understood from the graph that when the value of (tp/∈p)/(tt/∈t) is 0.5 or above, the size of the electric field Ey can be securely −0.4 or above. Therefore, it is preferable that the following expression is established. 0.5≦(tp/∈p)/(tt/∈t). In other words, the following expression is preferably established.

$$(tt/\in t)/2 \in (tp/\in p) \quad (d)$$

Further, it can be understood from the graph that when the value of (tp/∈p)/ (tt/∈t) is 1 or above, the size of the electric field Ey can be securely −0.25 or above. Therefore, it is preferable that the following expression is established. 1≦(tp/∈p)/(tt/∈t). In other words, the following expression is preferably established.

$$(tt/\in t) \leqq (tp/\in p) \quad (e)$$

Figure 19:
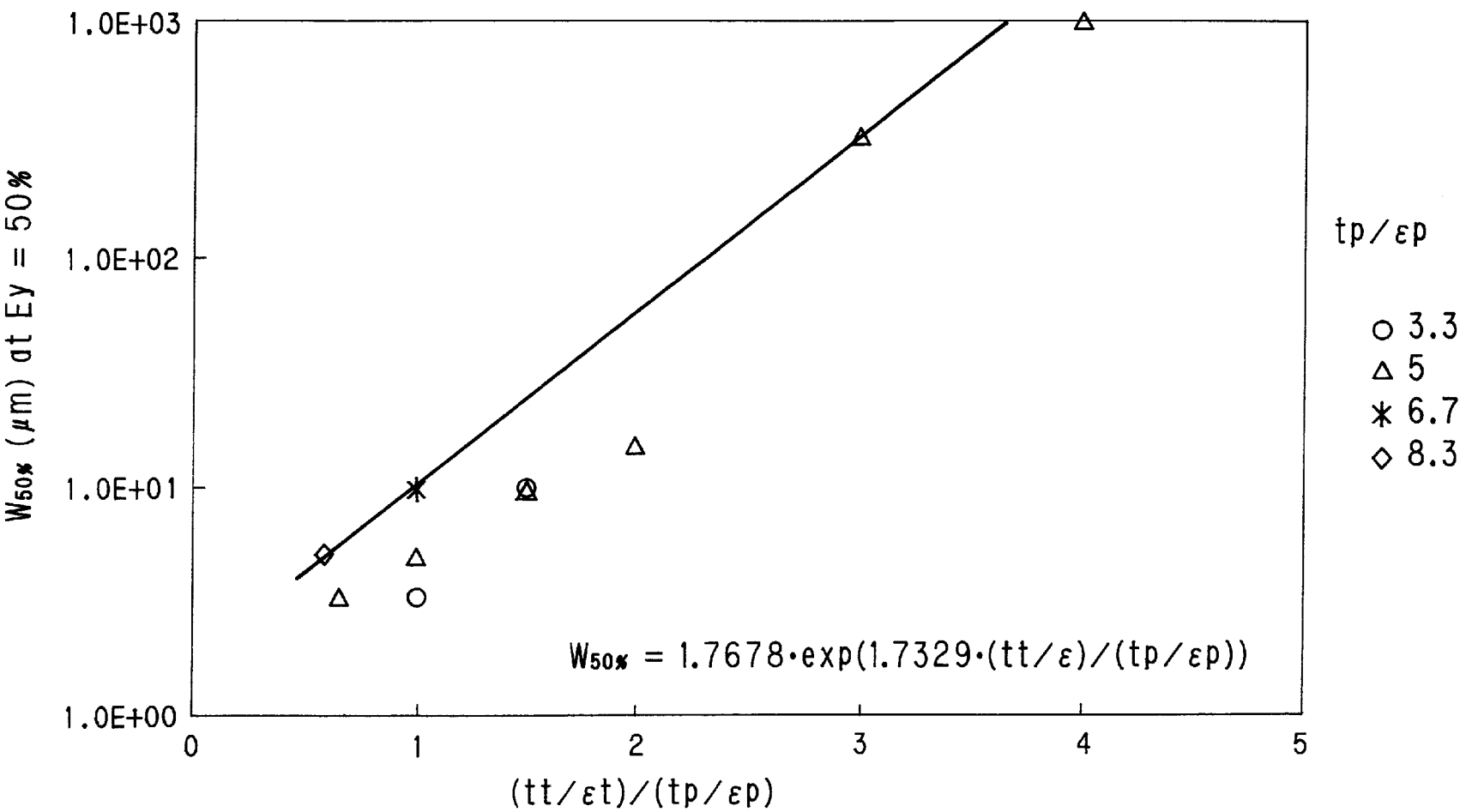
FIG. 19 is a graph (a semi-logarithmic graph) that shows a result of plotting a minimum width W50% of an electrostatic latent image corresponding to values of (tt/∈t)/(tp/∈p).

Further, in the result of the simulation 2, a minimum value of W (W50%) at which the size of the electric field Ey becomes 0.25 has been retrieved. FIG. 19 is a graph (a semi-logarithmic graph) that shows a result of plotting the minimum width W50% corresponding to the values of $(tt/\in t)/(tp/\in p)$. As shown in this graph, a relationship between each plot point and $(tt/\in t)/(tp/\in p)$ can be expressed in one straight line P; $W50\%=1.7678 \exp(1.7329\cdot(tt/\in t)/(tp/\in p))$. Therefore, when one $(tt/\in t)/(tp/\in p)$ has been decided, the size of the electric field Ey can be set equal to or above −0.25 when the width W of the electrostatic latent image is set larger than a value given by the straight line P. Therefore, it can be understood that it is preferable that the following relationship is established.

$$W50\%=1.7678\exp(1.7329\cdot(tt/\in t)/(tp/\in p))W\geqq 1.77\exp(1.73\cdot(tt/\in t)/(tp/\in p))$$

Therefore, $Ln(W/1.77)\geqq 1.73\cdot(tt/\in t)/(tp/\in p)$

In other words, $$(tt/\in t)\leqq Ln(W/1.77)\cdot(tp/\in p)/1.73 \quad (g)$$

The above result is summarized as follows.

In order to restrict the toner electric field to the direction for the dielectric layer 54 and to prevent the toner scattering, it is preferable that the expression (a) is established.

$$(td/\in d)\geqq(tp/\in p) \quad (a)$$

In order to set the electric field from the latent image given from the toner to a value smaller by 20% or above than the electric field from the area not formed with a latent image thereby to restrict the edge effect, it is preferable that the expression (b) or (d) is established.

$$(td/\in d)/(tp/\in p)\leqq 8 \quad (b)$$

$$(tt/\in t)/2\leqq(tp/\in p) \quad (d)$$

In order to set the electric field from the latent image given from the toner to a value smaller by 50% or above than the electric field from the area not formed with a latent image thereby to restrict the edge effect very effectively, it is preferable that any one of the expressions (c), (e) and (g) is established.

$$(td/\in d)/(tp/\in p)\leqq 2 \quad (c)$$

$$(tt/\in t)\leqq(tp/\in p) \quad (e)$$

$$(tt/\in t)\leqq Ln(W/1.77)\cdot(tp/\in p)/1.73 \quad (g)$$

The following expressions (1) and (3) can be prepared by combining the expression (a) with the expression (b) or the expression (d).

$$1\leqq(td/\in d)/(tp/\in p)\leqq 8 \quad (1)$$

$$(tt/\in t)/2\leqq(tp/\in p)\leqq(td/\in d) \quad (3)$$

$$(td/\in d)\geqq(tp/\in p)\geqq 1.73\cdot(tt/\in t)/Ln\ (W/1.77) \quad (6)$$

Therefore, when the dielectric constant and the thickness of the dielectric layer 54 are set to the range given by the expression (1) or (3), it is possible to prevent the toner scattering and to restrict the edge effect. The following expression (5) is the same as the expression (g).

$$(tt/\in t)\leqq Ln(W/1.77)\cdot(tp/\in p)/1.73 \quad (5)$$

Therefore, when the dielectric constant and the thickness of the dielectric layer 54 are set to the range given by the expression (5), it is possible to restrict the edge effect very effectively.

Further, the expressions (2) and (4) can be prepared by combining the expression (a) with the expression (c) or (e). Further, the expression (6) can be prepared by combining the expression (a) with the expression (g).

$$1\leqq(td/\in d)/(tp/\in p)\leqq 2 \quad (2)$$

$$(tt/\in t)\leqq(tp/\in p)\leqq(td/\in d) \quad (4)$$

$$(td/\in d)\leqq(tp/\in p)\leqq 1.73\cdot(tt/\in t)/Ln(W/1.77) \quad (6)$$

Therefore, when the dielectric constant and the thickness of the dielectric layer 54 are set to the range given by any one of the expressions (2), (4) and (6), it is possible to prevent the toner scattering and to restrict the edge effect very effectively.

The human sense of sight has characteristics that the resolution limit is 10 Lp/mm and that the gradation discrimination capacity is about 200 gradations in a low space frequency area of up to about 100 DPI, and that when the space frequency becomes higher, the gradation discrimination capacity is lowered and only the two-value state can be discriminated at 500 DPI. In order to satisfy the characteristics of the sense of sight, 2,400 DPI is necessary in a dot structure of two values. In the 2,400 DPI, in order to reproduce a fine oblique line, approximately 20 Lp/mm is required as a line takes a two-dot structure. As a gradation expression, it is possible to use 256 gradations for 150 pixels/inch.

As shown by oblique lines in FIG. 18, it is possible to achieve an image that satisfies the characteristics of the sense of sight by setting $(td/\in d)/(tp/\in p)$ so as to set electric field Ey in a positive area from the approximate curve of the expression (f). The latent image potential contrast C in the developing nip section needs to satisfy the following condition.

$$C > -0.204\cdot(Log(X))^2+0.737\cdot Log\ (X)+1.29 \quad (7)$$

where $X=(td/\in d)/(tp/\in p)$

As explained above, according to the developing apparatus that can carry out the control or the setting within the ranges of the expressions given by the present invention, it is possible to prevent the toner scattering and to restrict the edge effect very effectively. Further, it is possible to realize the picture quality that satisfies the characteristics of the human sense of sight.

What is claimed is:

1. A developing apparatus that is used in an electronic photographing apparatus, for carrying out a development by bringing a developing roller having a dielectric layer on its surface into contact with or bringing the developing roller close to a photosensitive layer, wherein the following expression (1) has been established:

$$1\leqq(td/\in d)/(tp/\in p)\leqq 8 \quad (1)$$

where $\in d$ and td represent a dielectric constant and a thickness of the dielectric layer respectively, and $\in p$ and tp represent a dielectric constant and a thickness of the photosensitive layer respectively.

2. The developing apparatus according to claim 1, wherein the following expression (2) has been established instead of the expression (1):

$$1 \leqq (td/\in d)/(tp/\in p) \leqq 2. \quad (2)$$

3. A developing apparatus that is used in an electronic photographing apparatus, for carrying out a development by bringing a developing roller having a dielectric layer on its surface into contact with or bringing the developing roller close to a photosensitive layer, wherein the following expression (3) has been established:

$$(tt/\in t)/2 \leqq (tp/\in p) \leqq (td/\in d) \quad (3)$$

wherein $\in d$ and td represent a dielectric constant and a thickness of the dielectric layer respectively, $\in p$ and tp represent a dielectric constant and a thickness of the photosensitive layer respectively, and $\in t$ and tt represent an apparent dielectric constant and a thickness of a toner layer formed on the dielectric layer respectively.

4. The developing apparatus according to claim 3, wherein the following expression (4) has been established instead of the expression (3):

$$(tt/\in t) \leqq (tp/\in p) \leqq (td/\in d). \quad (4)$$

5. A developing apparatus that is used in an electronic photographing apparatus, for carrying out a development by bringing a developing roller having a dielectric layer on its surface into contact with or bringing the developing roller close to a photosensitive layer, wherein the following expression (5) has been established:

$$(tt/\in t) \leqq Ln(W/1.77) \cdot (tp/\in p)/1.73 \quad (5)$$

wherein $\in p$ and tp represent a dielectric constant and a thickness of the photosensitive layer respectively, $\in t$ and tt represent an apparent dielectric constant and a thickness of a toner layer formed on the dielectric layer respectively, and W represents a minimum recording width of an electrostatic latent image that is formed on a photosensitive drum.

6. The developing apparatus according to claim 5, wherein the following expression (6) has been established instead of the expression (5):

$$(td/\in d) \geqq (tp/\in p) \geqq 1.73 \cdot (tt/\in t)/Ln(W/1.77) \quad (6)$$

wherein $\in d$ and td represent a dielectric constant and a thickness of the dielectric layer respectively.

7. A developing apparatus that is used in an electronic photographing apparatus, for carrying out a development by bringing a developing roller having a dielectric layer on its surface into contact with or bringing the developing roller close to a photosensitive layer, wherein the following expression (7) has been established:

$$C > -0.204 \cdot (Log(X))^2 + 0.737 \cdot Log\ (X) + 1.29 \quad (7)$$

wherein $X = (td/\in d)/(tp/\in p)$ wherein $\in d$ and td represent a dielectric constant and a thickness of the dielectric layer respectively, and $\in p$ and tp represent a dielectric constant and a thickness of the photosensitive layer respectively, subject to a condition that $C = (Vo - VL)/Vo$, wherein C represents a contrast of a latent image potential, Vo represents a surface potential of a photosensitive unit in an unexposed area, and VL represents a surface potential of a photosensitive unit in an exposed area.

* * * * *